US009038561B2

(12) United States Patent
Loui et al.

(10) Patent No.: US 9,038,561 B2
(45) Date of Patent: May 26, 2015

(54) PLANING HULL FOR ROUGH SEAS

(75) Inventors: Steven C. H. Loui, Honolulu, HI (US); Mealani Parish, Mililani, HI (US); Scott Yamashita, Honolulu, HI (US)

(73) Assignee: Navatek, Ltd., Honolulu, HI (US)

( * ) Notice: Subject to any disclaimer, the term of this patent is extended or adjusted under 35 U.S.C. 154(b) by 232 days.

(21) Appl. No.: 13/445,368

(22) Filed: Apr. 12, 2012

(65) Prior Publication Data

US 2012/0291686 A1 Nov. 22, 2012

Related U.S. Application Data

(63) Continuation-in-part of application No. 13/231,238, filed on Sep. 13, 2011, now abandoned.

(60) Provisional application No. 61/439,105, filed on Feb. 3, 2011.

(51) Int. Cl.
*B63B 1/32* (2006.01)
*B63B 1/04* (2006.01)

(52) U.S. Cl.
CPC ..... *B63B 1/042* (2013.01)

(58) Field of Classification Search
CPC ..... B63B 1/00; B63B 1/02; B63B 1/04; B63B 1/042; B63B 1/06; B63B 1/08; B63B 1/10; B63B 1/12; B63B 1/121; B63B 1/125; B63B 1/16; B63B 1/20; B63B 3/38
USPC ..... 114/271, 278, 283, 285, 288, 290, 291, 114/292, 56.1, 61.1, 61.26, 61.27, 61.29, 114/61.28, 61.3, 61.32, 61.33, 63, 140–143
See application file for complete search history.

(56) References Cited

U.S. PATENT DOCUMENTS 928,579 A 7/1909 Apel
1,559,660 A 11/1925 Ward (Continued)

FOREIGN PATENT DOCUMENTS

DE 2928634 11/1980
DE 0058716 3/1981

(Continued)

OTHER PUBLICATIONS

Triton Marine Brochure; copyright 1982; 4 pages.

(Continued)

*Primary Examiner* — Daniel V Venne
(74) *Attorney, Agent, or Firm* — Goodsill Anderson Quinn & Stifel LLP

(57) ABSTRACT

The disclosed watercraft hull has a flat pad keel whose width tapers towards the bow and its width at the transom is 15% to 25% of the hull's width at its chines. The hull is symmetric about its centerline, has a fine entry bow, a transom, and a pair of hard chines. Between the pad keel and the chines the hull has at least one pair of generally flat panels referred to herein as longitudinal steps having approximately 0 degrees of deadrize forming planing surfaces symmetrically located about the hull centerline. The hull also includes at least one pair of ultra high deadrize panels, outboard of and adjacent to the pad keel, located symmetrically about the hull centerline, and extending therefrom to the flat planing panels above them. The ultra high deadrize panels have a minimum average deadrize of approximately 50 degrees measured along their length. Additional flat planing surface structures having approximately 0° deadrize may be installed longitudinally on the hull between the pad keel and the hard chine such that the vertical offset between any two planing surfaces along the hull's stagnation line does not exceed approximately six inches. High deadrize panels or fillet panels with deadrize angles of between about 0.20 and 35 degrees may be included in the hull outboard of and adjacent to the ultra high deadrize panels and located symmetrically about the hull centerline. The fillet panels are tapered into wedge shapes at their forward ends to blend into the adjacent ultra high deadrize and flat planing panels.

30 Claims, 23 Drawing Sheets

(56) References Cited

U.S. PATENT DOCUMENTS

| | | | | |
|---|---|---|---|---|
| 1,656,411 | A | 1/1928 | Baldwin | |
| 2,020,792 | A | 11/1935 | Maynard et al. | |
| 2,735,392 | A | 2/1956 | Cox | |
| 2,989,939 | A | 6/1961 | Tatter | |
| 3,085,535 | A | 4/1963 | Hunt | |
| 3,148,652 | A | 9/1964 | Canazzi | |
| 3,203,389 | A | 8/1965 | Cale | |
| 3,237,581 | A | 3/1966 | Moesly | |
| 3,376,840 | A | 4/1968 | Zaphiriou et al. | |
| 3,415,213 | A | 12/1968 | Nemetz | |
| 3,450,090 | A | 6/1969 | Best, Jr. | |
| 3,515,087 | A | 6/1970 | Stuart | |
| 3,702,598 | A | 11/1972 | Szptyman | |
| 3,709,179 | A | 1/1973 | Payne | |
| 3,760,756 | A | 9/1973 | Boden | |
| 3,796,177 | A | 3/1974 | Szpytman | |
| 3,937,164 | A | 2/1976 | Austin | |
| 4,022,143 | A | 5/1977 | Krenzler | |
| D244,841 | S | 6/1977 | Nescher | |
| D245,902 | S | 9/1977 | Rogers | |
| 4,091,761 | A | 5/1978 | Fehn | |
| D252,507 | S | 7/1979 | Wood | |
| 4,159,691 | A | 7/1979 | Paxton | |
| 4,263,866 | A | 4/1981 | Shirley | |
| 4,348,972 | A | 9/1982 | Parsons | |
| D267,866 | S | 2/1983 | Parsons | |
| D283,416 | S | 4/1986 | Carlson | |
| 4,584,959 | A | 4/1986 | Allison | |
| D285,190 | S | 8/1986 | Pipkorn | |
| D286,870 | S | 11/1986 | Fairchild | |
| 4,813,366 | A | 3/1989 | Elder | |
| 4,862,817 | A | 9/1989 | Hornsby, Jr. et al. | |
| 4,989,534 | A | 2/1991 | Field | |
| D318,041 | S | 7/1991 | Meredith | |
| 5,140,930 | A | 8/1992 | Lund | |
| 5,163,377 | A | 11/1992 | Calderon et al. | |
| 5,191,849 | A | 3/1993 | Labrucherie et al. | |
| 5,237,953 | A | 8/1993 | Mannerfelt | |
| 5,265,554 | A | 11/1993 | Meredith | |
| D355,881 | S | 2/1995 | Carlson | |
| 5,402,743 | A | 4/1995 | Holderman | |
| 5,458,078 | A | 10/1995 | Perette | |
| 5,474,014 | A | 12/1995 | Russell | |
| 5,544,609 | A | 8/1996 | Miller | |
| 5,622,130 | A | 4/1997 | Calderon et al. | |
| 5,934,218 | A | 8/1999 | Chen | |
| 5,983,823 | A | 11/1999 | Allison | |
| 6,116,180 | A | 9/2000 | Thompson | |
| 6,186,086 | B1 * | 2/2001 | Zender et al. | 114/271 |
| 6,216,622 | B1 | 4/2001 | Lindstrom et al. | |
| 6,250,245 | B1 | 6/2001 | Robinson | |
| 6,345,584 | B1 | 2/2002 | Mascellaro | |
| 6,526,903 | B2 | 3/2003 | Robinson et al. | |
| 7,201,111 | B1 | 4/2007 | Burkett | |
| 7,305,926 | B2 * | 12/2007 | Seider | 114/61.1 |
| 7,418,915 | B2 | 9/2008 | Campbell | |
| 7,845,301 | B2 * | 12/2010 | Loui et al. | 114/284 |
| 2001/0052314 | A1 | 12/2001 | Chrunyk | |
| 2004/0103836 | A1 | 6/2004 | Burkett | |

FOREIGN PATENT DOCUMENTS

| | | |
|---|---|---|
| EP | 0298050 | 6/1988 |
| FR | 1047765 | 7/1953 |
| FR | 1083742 | 6/1954 |
| FR | 2078967 | 10/1971 |
| GB | 1545900 | 7/1976 |

OTHER PUBLICATIONS

Powerboat Magazine, Sep. 1982; pp. 68-71; p. 98.
Yacht and Boat Owner; Jun. 1981; Vortex a unique design concept; pp. 72-73.
Practical Boat Owner, Aug. 1983; Get Up and Go!; pp. 50-51.
Motor Boat and Yachting Jul. 1978; Blagg 480, p. 85.

* cited by examiner

PLANING HULL FOR ROUGH SEAS

This application claims the benefit of U.S. Provisional Application No. 61/439,105 filed Feb. 3, 2011 and U.S. patent application Ser. No. 13/231,238 filed Sep. 13, 2011; the disclosures of both which are incorporated herein by reference.

This application is a continuation-in-part of U.S. patent application Ser. No. 13/231,238.

TECHNICAL FIELD

The present invention relates to a watercraft, and particularly, to a watercraft hull having a very high deadrise central planing hull portion including longitudinal flat planing steps or panels.

BACKGROUND OF THE INVENTION

Watercraft which are designed to operate in the planing mode are well known. Empirical evidence based on naval architecture and hydro-dynamic research, testing and experimentation has established beneficial performance attributes from three important features of such watercraft.

First, flat bottom planing hull surfaces with 0 degree deadrise angles are known to achieve the most efficient planing lift forces when operating at optimal trim angles. A watercraft utilizing flat planing surfaces will therefore generate more efficient planing lift than one with planing surfaces with higher deadrise. However, conventional wisdom is that a watercraft with exclusively flat planing surfaces cannot achieve high seakeeping and seakindliness in rough seas.

Watercraft with a relatively flat or shallow V planing hull bottom, as measured relative to the horizontal, have efficient planing lift and are very stable, but have very poor seakeeping in rough seas, i.e., they also lack seakindliness and directional stability in rough seas.

Consequently, watercraft with a deep V hull bottom were developed to introduce better seakeeping and directional stability. The hulls of such boats, as taught in U.S. Pat. No. 3,237,581 and U.S. Pat. No. 3,085,535, are typically "V" shaped in cross section, with each leg of the V being generally flat and forming an angle to the horizontal, known as the deadrise angle, of approximately 20 to 30 degrees. The deadrise increases toward the forward end of the boat, and as a general rule, has a deadrise greater than 43 degrees at the bow to provide a fine entry. As such boats move forward in the water the narrow bow entry slices through the water, while the flatter surfaces aft provide some planing area, providing a balance between planing lift and seakeeping.

The planing lift for conventional deep-V hulls is typically augmented by the provision of running strakes on the hull surfaces as shown in FIG. 1. These strakes are usually strips of triangularly shaped elements, in cross-section, appended to the outer hull surface that provide additional surface area for additional lift. They also cleanly separate water flow off the hull to reduce spray and drag. Indeed these strakes were originally called "spray strips."

Despite the improvements found with the deep V hull design, planing boats can provide uncomfortable rides. With too high a running trim, the bow pitches up over the crest of the wave, then plunges downward slamming back to the free surface. Another type of slamming occurs when the hull completely leaves the water, and is called re-entry slamming.

Conventional deep-V hulls will have excellent seakeeping if they can be controlled to run at speed with low trim while remaining upright (i.e., not heeled to either side). The stable mode of operation with the waterflow along the hull is shown in FIG. 2*a*. Maintaining a conventional planing hull upright however is difficult to achieve since the deep-V hull is characteristically soft in roll and will heel in response to any asymmetric load such as weight shift, propeller torque, cross wind and waves. A dynamic system may be added to control the boat attitude; however, this adds complexity and cost.

When a deep-V boat heels to either side, its effective deadrise is decreased by the heel angle such that it loses the low slamming benefits of a deep-V hull. For example, a 24 degree deadrise hull heeled over by 10 degrees becomes a 14 degree deadrise hull normal to the water surface. In very high seas, it is not atypical for a small craft to experience up to 15 degrees of heeling so that the effective 9 degree deadrise surface is relatively flat to the water and pounds in waves, as illustrated in FIG. 2*b*.

A particularly dangerous condition in which to have excessive roll is when turning in rough seas from a head to a quartering to a beam sea. Heeling over during this maneuver causes excessive pounding and uncomfortable to dangerous levels of roll.

A steeper deadrise than conventional deep V hulls would greatly improve the seakeeping and seakindliness of the hull. Even when heeled over, the surface of a deeper V hull will retain a significant deadrise relative to the water surface and thus cushion any impacts. Furthermore, the higher deadrise hull has less pitch excitation, thus allowing the hull forebody to penetrate the wave rather than kiting off of it. One such example is shown in U.S. Pat. No. 3,415,213. However, it appears that several problems must be resolved before a planing monohull with an extremely high deadrise can be successfully reduced to practice. For example, an extremely deep V hull has greater stability problems than a deep V being even more tender in roll. Further, although the orientation of its surfaces relative to the water improves its seakeeping and seakindliness, an extremely deep V hull also produces far less dynamic lift than a flatter hull. The inadequate planing lift of a deeper V makes getting over critical speed, also called hump speed, more difficult, reduces the payload capacity, and increases operating draft. In addition, the limited hull width of an extremely deep V restricts arrangements and has low internal volume.

Also, narrow watercraft hulls with ultra high deadrise angles greater than 50 degrees and typically greater than 60 degrees in forward sections are known to transit through waves by penetrating and slicing into them with less heave and pitch vertical motion excitation than a hull with lesser deadrise, thereby improving a watercraft's seakeeping and seakindliness. The hull can have sufficient vertically arranged and increasing buoyant volume to provide progressive lift to counter hull plunging motions when transiting through wave troughs; however, conventional wisdom on these vessels is that a watercraft with ultra high deadrise panels cannot achieve high lift and planing efficiencies.

Finally, monohulls, with higher fineness ratios, improve seakeeping of watercraft but can have static and dynamic stability issues as well as non-optimal running trims. However, conventional wisdom is that a narrow planing hull is not as efficient as a wider hull and cannot carry as heavy loads. But, watercraft with entrapment tunnels and amas improve a narrow vessel's stability at rest or at speed and improve the vessel's ability to achieve critical planing speeds and carry high loads.

SUMMARY OF THE INVENTION

It is an object of this invention to provide a novel watercraft planing hull with improved seakeeping and seakindliness (in rough seas), seaworthiness, stability, planing efficiency, and payload capacity.

It is also an object of this invention to improve boat handling by providing a planing hull that produces fully banked turns and eliminates heeling and chine walking.

It is another object of the invention to provide a watercraft hull that will operate with substantially lower slamming than a conventional deep-V hull, especially when the hull hits the water surface heeled to a side when the hull is not symmetrically upright.

Such a craft could find use in military, commercial, and recreational boating markets, or in other words, applications that require a high seakeeping, high payload capacity craft that is able to maintain its speed and course in a seaway without excessive slamming or discomfort to the crew.

BRIEF DESCRIPTION OF THE INVENTION

The subject of this invention is a watercraft hull formed with at least one pair of flat planing panels, also referred to herein as a "longitudinal step", which have substantially 0 degree deadrise angles and at least a pair of ultra high deadrise (UHD) panels associated therewith and connected to a pad keel, with a fine bow entry, and hard chine. The watercraft hull may also include a pair of outboard amas or sponsons that are symmetric about the hull centerline.

In accordance with one aspect of the present invention an entrapment tunnel monohull watercraft is provided that has a central hull portion formed of at least a pair of relatively flat panels having substantially 0 degree deadrise on opposite sides of the hull's centerline and a pair of ultra high deadrise panels associated therewith having deadrise of 50° or greater throughout the length of the hull. The ultra high deadrise panel arrangement improves seakeeping and seakindliness while maintaining the directional stability and performance for which entrapment tunnel hulls are well known.

In accordance with another aspect of the invention the described hull may include relatively flat panels (when viewed in transverse cross section), referred to herein as "fillet panels", bridging the flat 0 degree deadrise panels defining the longitudinal steps and adjacent ultra high deadrise panels and whose deadrise is between 20 degrees and 35 degrees at the transom. These fillet panels taper to blend into the UHD panels and the flat panels or longitudinal steps going forward to provide more width for more favorable arrangements and better maneuvering capabilities, while staying consistent with the seakeeping and seakindliness features of the hull.

In accordance with another aspect of the invention the described hull features longitudinal steps that are relatively flat and substantially wide planing panels as integral parts of the hull having deadrise of about 0 degrees and variable widths in order to augment planing lift, improve seakindliness, and optimize efficiency.

A still further aspect of this invention is a planing watercraft with a hull form designed to be seaworthy, seakindly, stable and efficient when operating in rough seas that is comprised of generally flat panels to form planing surfaces with approximately 0 degree deadrise to which panels having ultra high deadrise angles greater than approximately 50 degrees are attached. The watercraft is symmetric about its hull centerline longitudinal axis with a fine entry bow, transom stern, hard chines with large planing flats, and a flat pad keel tapered towards the bow. The 0 degree deadrise surface defines at least one longitudinal hull step on each side of the hull configured between the pad keel and hard chines. Unlike existing planing craft, the planing stagnation lift line achieved by the hulls of the present invention is not a continuous line but rather a segmented one since the ultra high deadrise panels between stagnation planing lift surfaces provide relatively very little lift. It has been found that such a lift discontinuity can cause insufficient planing lift stability to the watercraft unless there are at least two stagnation lift planing surfaces between the pad keel and chine planing flats and the vertical offset between any two planing surfaces along the planing stagnation line is less than 6 inches. With the aforementioned longitudinal hull steps as the first stagnation lift planing surfaces, the second stagnation lift planing surface can be another longitudinal hull step with planing flats, triangular shaped running strakes or simple flat plate strips attached to the hull.

In accordance with another aspect of the invention, high deadrise fillet panels 41 with deadrise angles between 20 and 35 degrees are attached between the ultra high deadrise panels that are attached to the sides of the pad keel and the lowest longitudinal hull step planing flats. The fillet panels 41 are employed to reduce peak slamming pressures attributable to the longitudinal step planing surface and reduce hull wetted surface area frictional drag and are tapered into wedges at their forward end to blend into the adjacent hull panels. In addition ventilated aft swept flow interrupters (VASFI) may be installed in the hull fillet panels 41 to improve seakeeping by maintaining an optimal running trim, to improve hull loading lift efficiency, to reduce hull wetted surface area frictional drag and to improve the watercraft's turning capabilities.

Still further, the watercraft may have one or more ventilated transverse hull steps. The steps improve seakeeping by maintaining an optimal running trim, improve hull loading lift efficiency and reduce hull wetted surface area frictional drag. Transverse steps that incorporate an aft sweep will also improve the watercraft's turning capabilities.

Transverse stability improving means may also be symmetrically attached to the watercraft outboard of the chine. The transverse stability improving means alternatives include entrapment tunnels, struts, amas, sponsons, demi-hulls, hydrofoils, lifting bodies, buoyancy collars including types that are inflatable, double chine hull panels and/or a combination thereof.

In another aspect of the invention, two or more hulls made according to the invention can be joined by a cross structure to form a multi-hulled watercraft.

In another aspect of the invention, the hull can be separated into two half hulls along the centerline longitudinal axis and each half made watertight. The two halves can be separated transversely from each other and joined by a cross structure to form an asymmetric catamaran.

The above and other objects, features and advantages of the present invention will be apparent in the following detailed description of illustrative embodiments thereof when read in connection with the accompanying drawings wherein:

DETAILED DESCRIPTION OF THE PREFERRED EMBODIMENTS OF THE INVENTION

Figure 1:
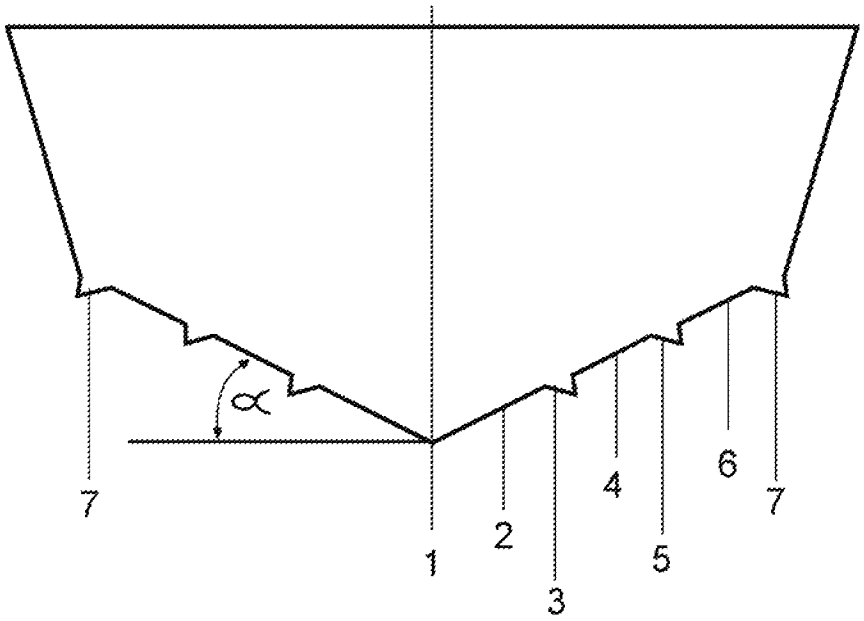
FIG. 1 Prior Art
FIG. 1 is a transverse cross-section at the transom of a conventional deep V planing hull.

Referring now to the drawings in detail, FIG. 1 shows the transverse cross-section, at the transom, of a conventional deep-V hull. The hull has a V shaped bottom, including a conventional narrow keel 1, a plurality of (in this case three) pairs of flat panels 2, 4, and 6, separated by longitudinal strakes 3 and 5, and flat chines 7. The strakes are typically narrow wedge shaped elements with reverse deadrise primarily intended to separate water spray from the hull. The deadrise angle $\alpha$ for all the flat panels 2, 4 and 6 of the hull at the aft end or transom 8 is generally between 20 and 30 degrees. Typically, such hull panels increase in deadrise moving forward to a deadrise of about 43 degrees or slightly higher to provide a bow entry to slice through waves rather than slamming into them. The hull also includes a conventional curved bow 9 (see FIG. 2*a*), a forebody section, and a forefoot.

Figure 2B:
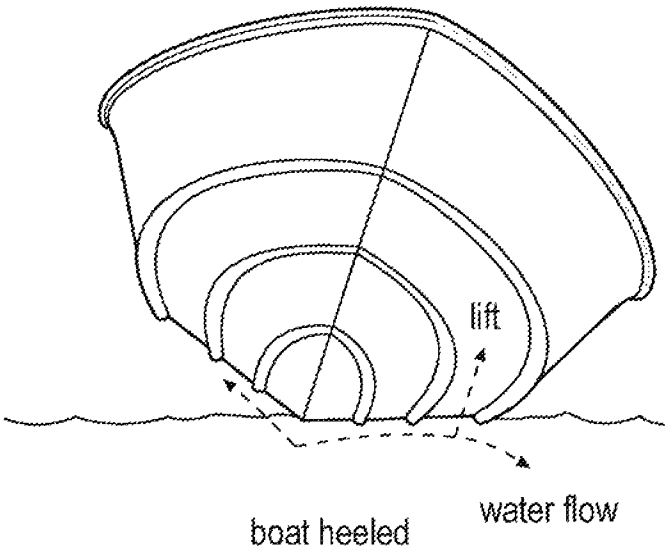
FIG. 2b Prior Art
FIG. 2*b* is also a front view of the hull of FIG. 1 shown impacting on its side and slamming the water when it is heeled over.
Figure 2A:
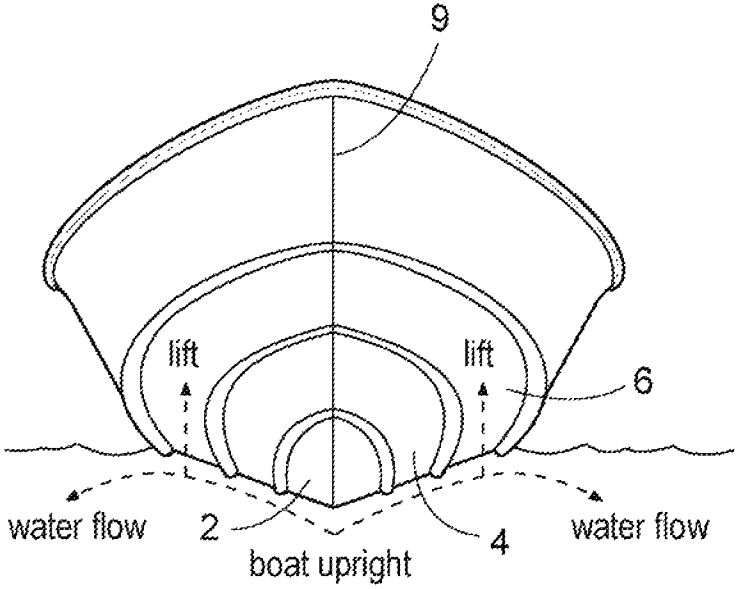
FIG. 2a Prior Art
FIG. 2*a* is a front view of the hull of FIG. 1 landing upright on the water surface and cushioning the landing.

As noted above, contemporary deep V hulls possess relatively good seakeeping characteristics; however, their abilities are limited and need much improvement. Seakeeping of such hulls remains acceptable when the conventional hull is controlled to run at speed with low trim while remaining upright as shown in FIG. 2*a*. However, maintaining conventional deep V planing hulls upright is difficult due to their softness in roll. When a deep V hull heels over, as seen in FIG. 2*b*, its effective deadrise is decreased by the heel angle such that it loses the low slamming benefits of a deep V hull.

It has been found that at high speeds a deadrise between 50 and 65 degrees is required to mitigate slamming, particularly in the uppermost hull panels. In accordance with the present invention, the hull deadrise angle of the central planing hull portion is increased along its entire length such that it has enough deadrise to mitigate high speed slamming. In addition longitudinal planing steps are provided to provide planing lift surfaces.

FIGS. 3*a*, 3*b*, 3*c*, 3*d*, and 3*e*, provide various views of a first embodiment of a watercraft hull 10 according to the present invention. Multiple embodiments of the invention are described hereinafter and common reference numerals are used in the specification and drawings to indicate like parts.

Hull 10 has a bottom 12 including a substantially flat pad keel portion 30 and a pair of angularly related flat panels 31, immediately outboard and adjacent to the pad keel 30, which are symmetric about the hull centerline 14. The flat pad keel has a generally uniform width in the aft half of the hull having a width of about 15 to 25% of the hull width at the outer hull chines as measured at the transom. The pad keel tapers from about amidship forward to its apex 40 and curves upwardly. The panels 31 possess an Ultra High Deadrise (UHD) significantly greater than a conventional V hull and they extend the full length of the pad keel 30 from the transom 16 to the pad keel apex 40 (FIGS. 3*c* and 3*d*). That apex may be located adjacent to or at the forefoot 42 of the hull or between the forefoot and the intersection of the hull's design waterline 42' with the bow 11.

Hull 10 also includes one or more pairs of additional upper UHD panels which also are symmetrically located about the hull centerline. In the embodiment seen in FIG. 3*a*, the hull includes two pairs of upper UHD panels 34 and 36. The UHD panels 31, 34, and 36 have deadrise angles B, E, and G, as seen in FIG. 3*e* respectively, that are approximately 50 degrees or more at the transom. The deadrise of the UHD panels can be identical or different. In a preferred embodiment, the deadrise B, E, and G of the UHD panels 31, 34, and 36 are all 50 degrees at the transom and increase in deadrise angle in the bow area to provide a fine bow shape.

Watercraft hull 10 of this invention also includes a first pair of longitudinal steps, including longitudinal step 32 located immediately outboard and adjacent to the upper ends of UHD panels 31 symmetrically about the hull centerline. This first pair of longitudinal steps, including longitudinal step 32, form flat planing surfaces and have a deadrise of approximately 0 degrees at the transom and along their entire length. The width dimension of each step in the first pair of longitudinal steps, including longitudinal step 32, will vary with the length and width of the hull and their combined width may be 14% to 20% of the width at the hull chines as measured at the transom 16, and vertically spaced a dimension D (FIG. 3*e*) no less than four inches above the pad keel. In the embodiment of FIG. 3 the watercraft hull also includes a second pair of longitudinal steps, including longitudinal step 33 located between the top edge of UHD panels 34 and the lower edge of UHD panels 36. These steps also have approximately a 0 degree deadrise along their length, and are symmetrically arranged about the hull.

Figure 3A:
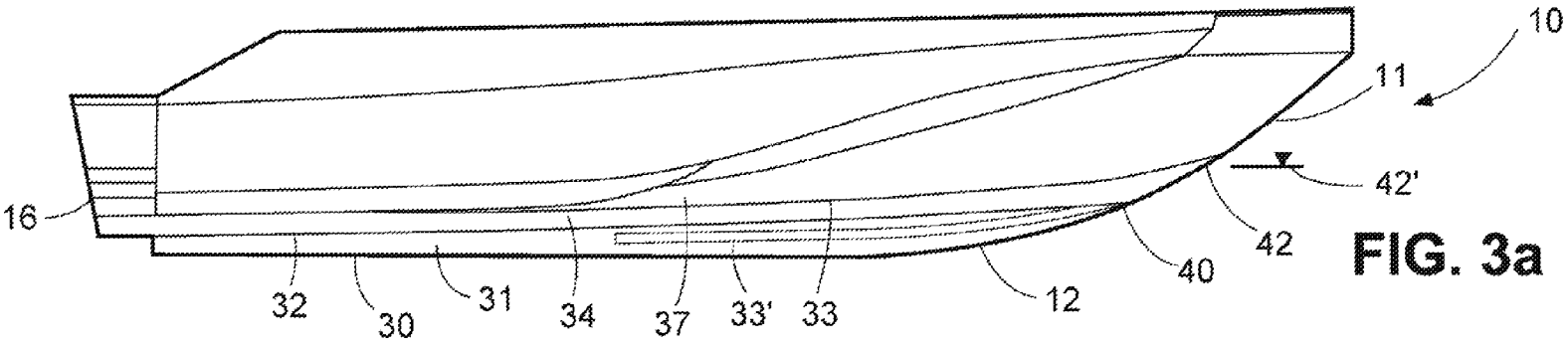
FIG. 3*a* is a side view of a watercraft hull designed in accordance with one embodiment of the invention.
Figure 3C:
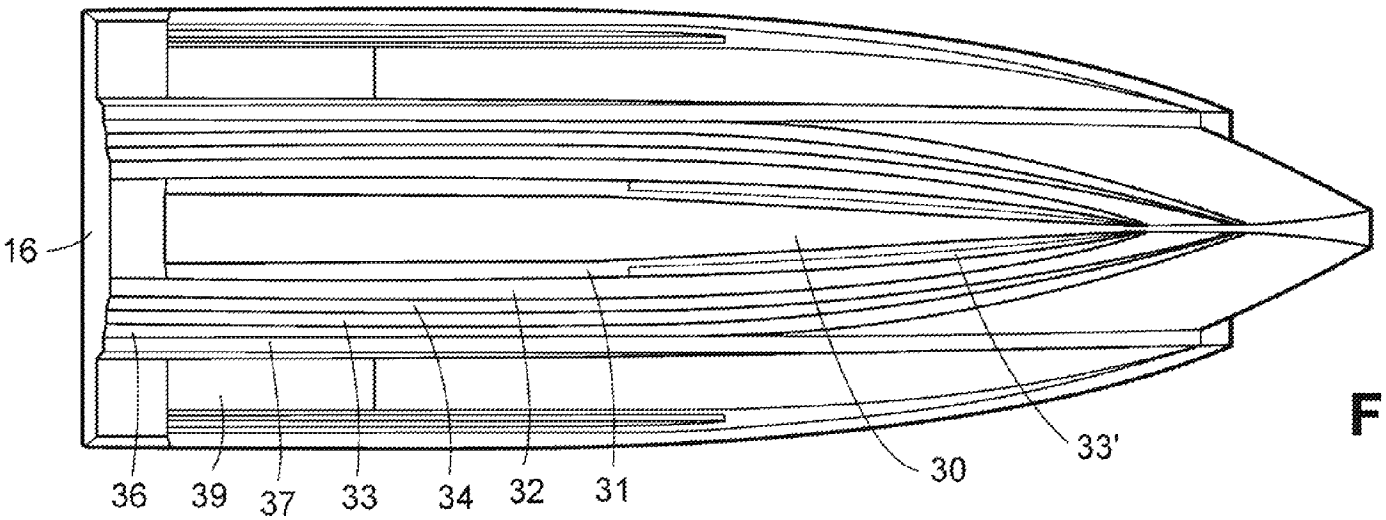
FIG. 3*c* is a bottom view of the hull shown in FIG. 3*a;*
Figures 3B, 3D:
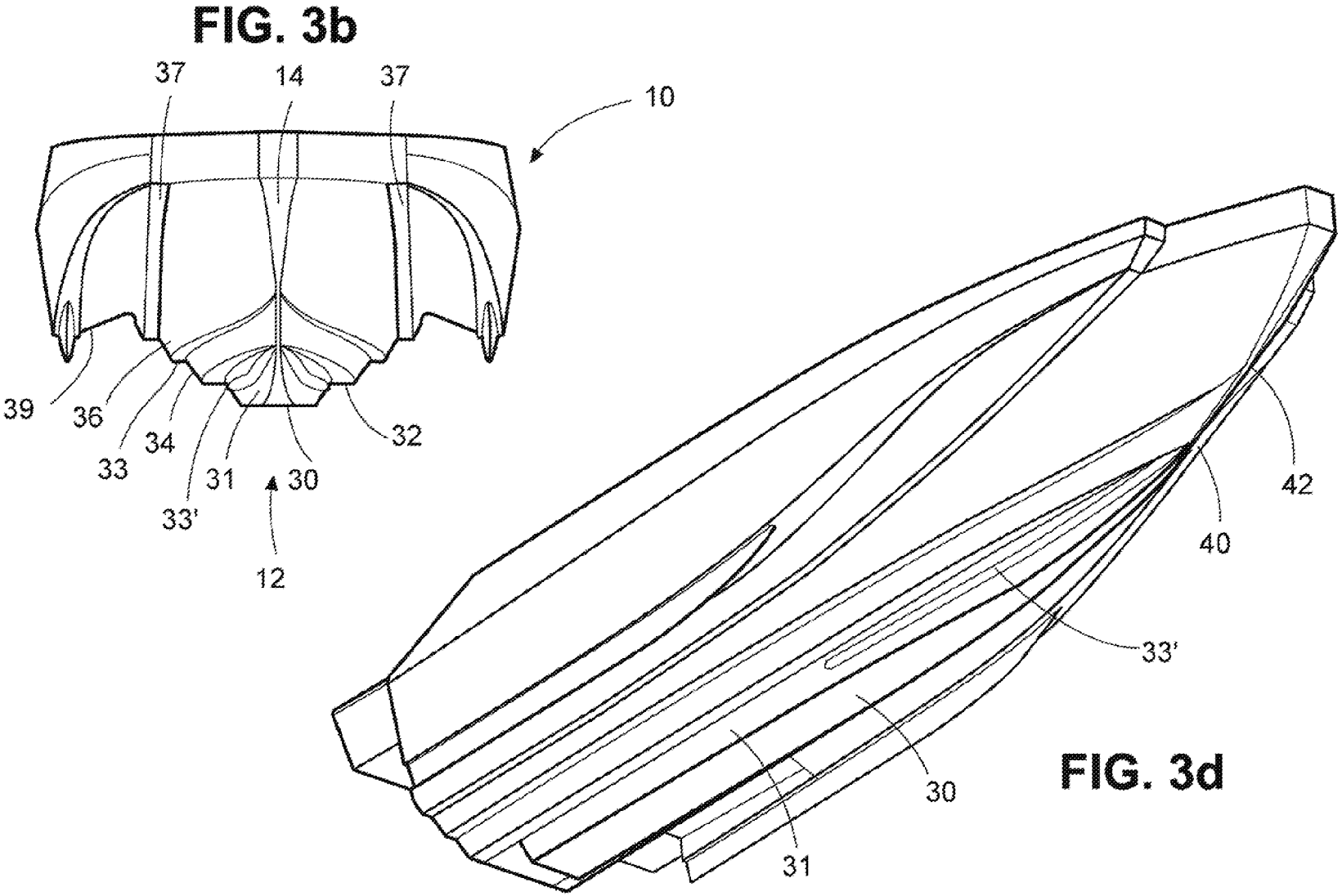
FIG. 3*b* is a front view of the watercraft hull shown in FIG. 3*a;*
FIG. 3*d* is a bottom perspective view of the hull shown in FIG. 3*a;*
Figure 3E:
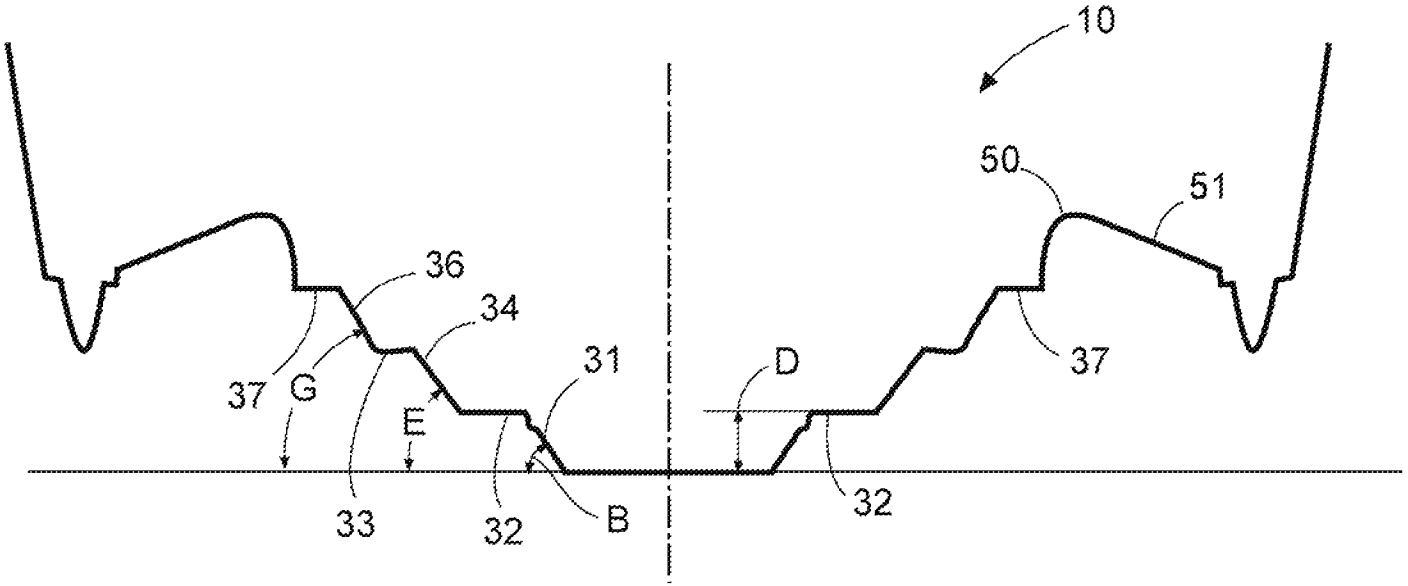
FIG. 3*e* is an aft view of the hull shown in FIG. 3*a* showing the deadrise and width dimensions of interest.
Figure 4A:
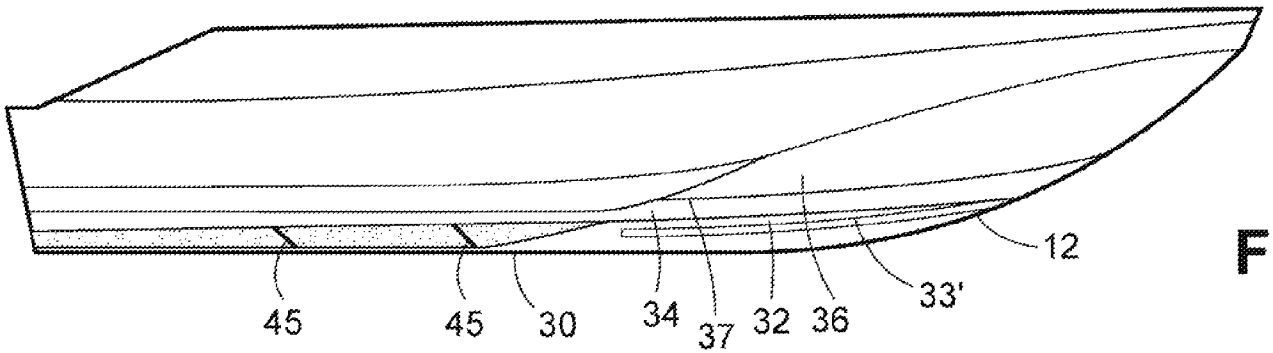
FIG. 4*a* is a side view of another embodiment of the present invention.
Figure 4C:
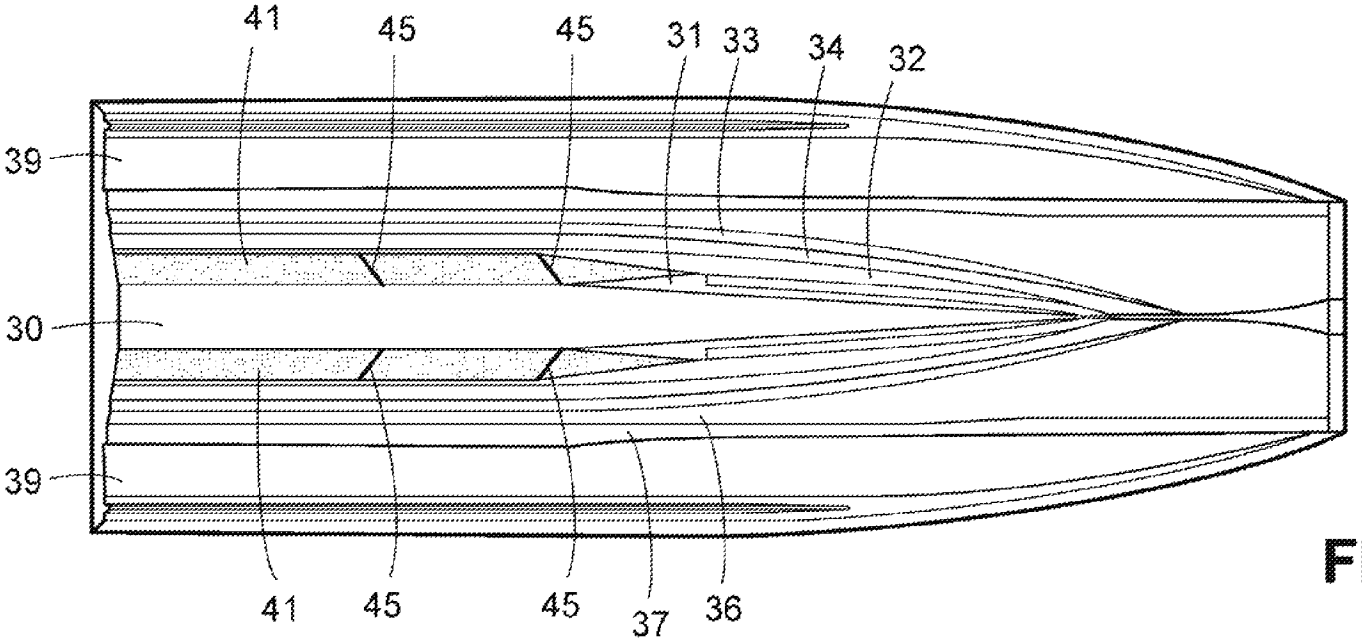
FIG. 4*c* is a bottom view of the hull of FIG. 4*a;*
Figure 4D:
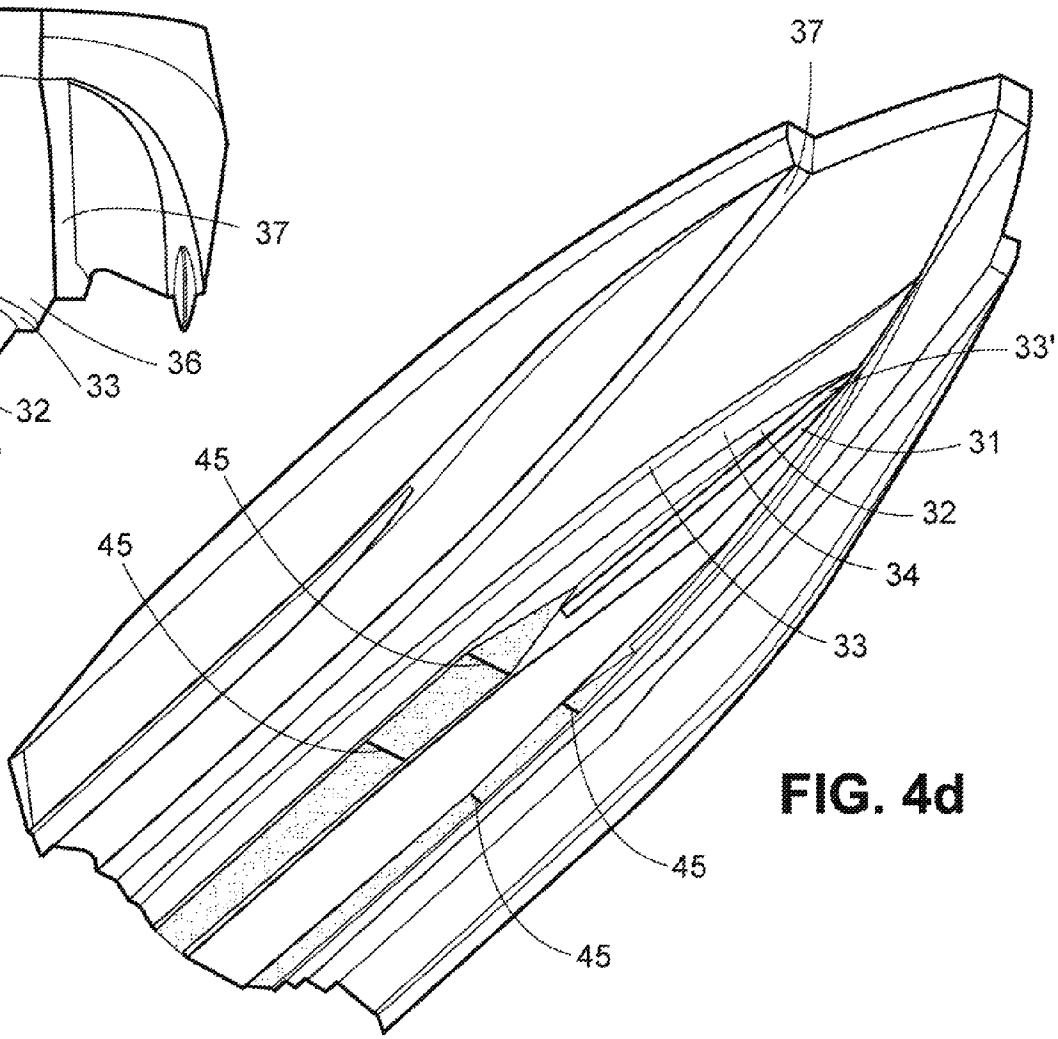
FIG. 4*d* is a bottom perspective view of the embodiment of FIG. 4*a;*
Figure 4B:
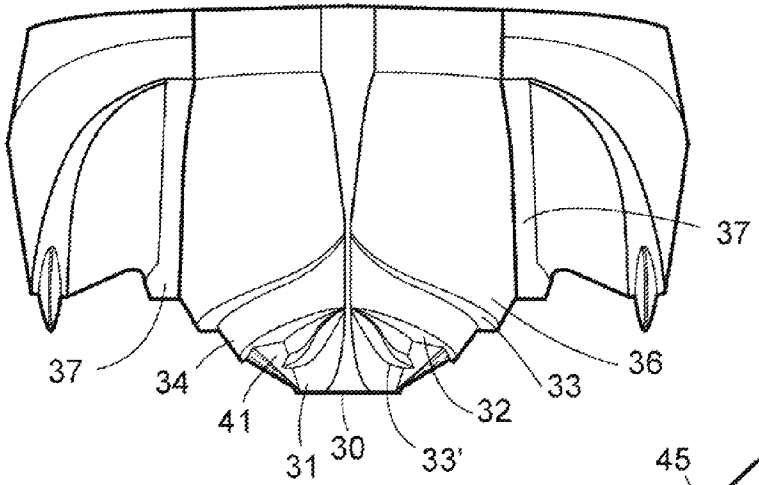
FIG. 4*b* is a front view of the embodiment of FIG. 4*a;*

As seen in FIGS. 3*a* and 3*b* the UHD panels 36 decrease in height as they move toward the bow of the hull and form an apex at the bow; the first pair of longitudinal steps, including longitudinal step 32, and the second pair of longitudinal steps, including longitudinal step 33, follow the curvature of the hull and also curve upwardly in the bow. As a result the height of the UHD panels 31 and 34, while remaining relatively uniform in the aft and mid sections of the hull, increases in the bow area. It has been found that while the height of the UHD panels can be varied with the size of the vessel, the operation and seakindliness of the vessel is improved if the vertical offset between vertically spaced planing surfaces does not exceed 6 inches. With a higher vertical spacing in rough water where the vessel is pounding on waves the delay between engagement of the successive planing surfaces can become too great and can cause uncomfortable slamming. To overcome this concern and maintain the benefits of the presence of the UHD panels in water reentry additional flat planing devices such as wedge or triangularly shaped strakes 33', having flat approximate 0 degrees of deadrise and a width of no more than 4% to 7% per side of the hull chine width measured at the transom, may be placed in those areas of a UHD panel where the vertical spacing between the first pair of longitudinal steps, including longitudinal step 32, and the second pair of longitudinal steps, including longitudinal step 33, exceeds 6 inches. In the embodiment of FIG. 3, the demi-strakes 33' are mounted on the panels 31 in the bow area between the pad keel and the first pair of longitudinal steps, including longitudinal step 32 where the height of the panels exceed six inches and are extended from there to the bow. Outboard of the last UHD panel 36 the main hull portion includes hard chines 37 having a flat to slight reverse deadrise which extend along the top of UHD 36 to a point about amidships and then follow the curvature of the hull to the bow portion of the vessel. Alternatively, the chine may have a severe reverse deadrise or a concave curvature.

The innovative use of UHD panels and first pair of longitudinal steps and second pair of longitudinal steps, including longitudinal step 32 and longitudinal step 33, respectively as described above allows for the vessel to provide superior seakeeping, while maintaining turning and maneuvering capabilities and providing more width for favorable arrangements.

Figure 8B:
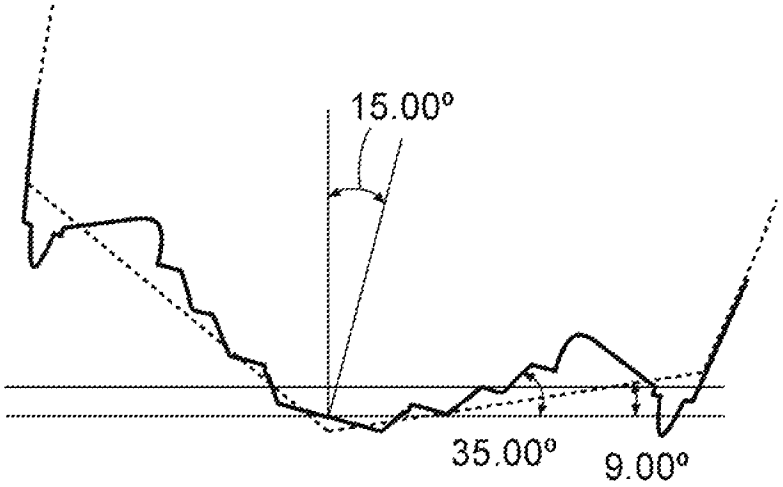
FIGS. 8*a* and 8*b* are schematic cross-sectional views at the transom of a watercraft according to the present invention, similar to FIG. 3*a* and respectively including, in dashed lines, as an overlay, the transom cross-section of a conventional deep V planing hull landing upright, and heeled over.
Figure 8A:
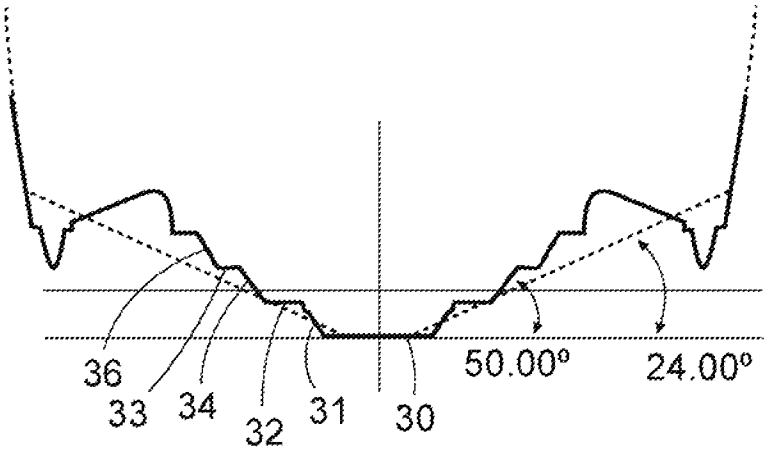
Figure 8E:
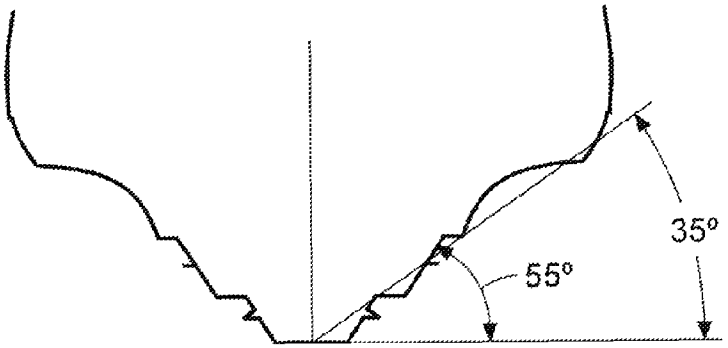
FIGS. 8*e* and 8*f* are similar views to FIGS. 8*c* and 8*d* but taken midship of the embodiment of FIG. 6*a;*
Figure 8C:
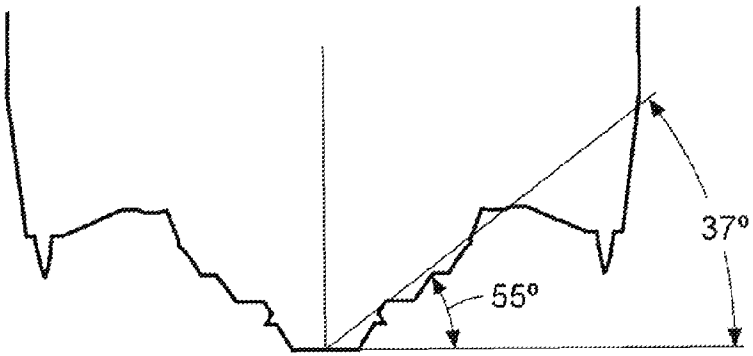
FIGS. 8*c* and 8*d* are similar views taken midship of the embodiment of FIG. 5*a;*
Figure 8F:
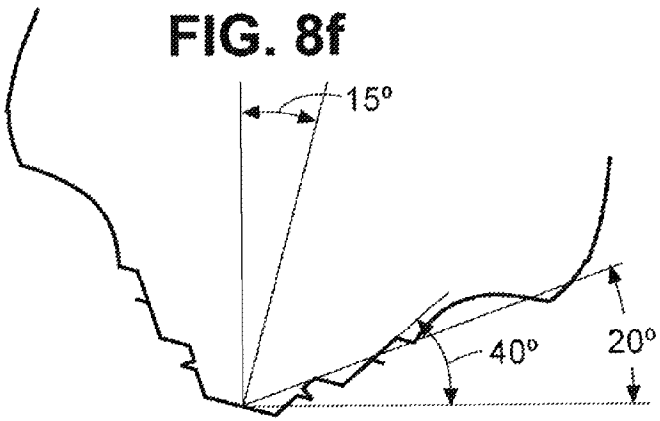
Figure 8D:
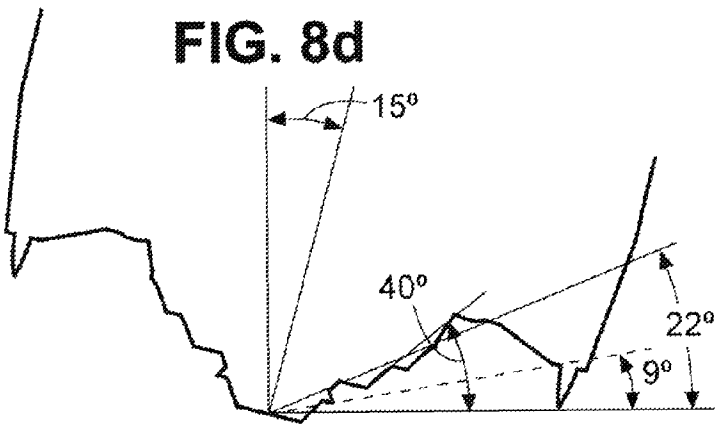

This is shown, for example, with reference to FIGS. 8*a* and 8*b* which illustrate a schematic cross-section of the hull of FIG. 3 including in dotted lines the outlines of a conventional V hull as shown in FIG. 2. When an ultra deep V hull according to the present invention is heeled up to say 15 degrees as shown in FIG. 8*b*, as compared to what is seen in FIG. 2*b* the hull's UHD panels heel into the seaway and retain a deadrise as much as or greater than a conventional deep V hull which has a deadrise of 20 to 30 degrees. If the UHD panels have a deadrise of 50 degrees, and there is 15 degrees of heel, the effective deadrise is 35 degrees on the impacting hull panel, thereby greatly reducing slamming and pounding of the hull even when heeled over.

As also seen in FIG. 3*a*, the hull of this invention may also feature amas or sponsons that form entrapment tunnels 39. Entrapment tunnel planing hulls are well known in the art. They provide longitudinal tunnels alongside a central planing hull portion, i.e., between the central hull portion and outboard sponsons or amas. These tunnels are designed to entrap dynamic air and hydraulic pressure from the central and amas hull portions at speed to create greater hull lift raising the hull further out of the water. This reduces wetted surface area on the hull, and increases speed and efficiency.

An improved form of an entrapment tunnel was proposed in U.S. Pat. No. 7,418,915. The hull disclosed in that patent includes outboard amas which provide the benefits of mitigation of capsizing, efficient progressive lift, and improved directional stability for navigation course keeping.

An entrapment tunnel is formed in this embodiment between the hard chine 37 on the hull, the tunnel ceiling, and a depending ama. These surfaces may be shaped using a pair of splined curve shapes, or they may be constructed of relatively flat or curved panels 50, 51 (as shown in FIGS. 3*e*, 5*e* and 6*e*). The inner surfaces of the tunnel of this invention can also be formed as taught in U.S. Pat. No. 7,418,915, the disclosure of which is incorporated herein by reference.

Both the amas and both pairs of longitudinal steps, including longitudinal steps 32 and 33 provide transverse stability to help keep the hull upright both at rest and underway in tough seas. As noted above, a hull that remains upright provides superior seakeeping and seakindliness.

It is also noted that in this embodiment the roof of the tunnel 39 terminates in a step several feet forward of the transom 16 to allow for the placement of trim tabs in the aft end of the tunnels.

Referring now to FIGS. 4*a*-4*d* another embodiment of the present invention is illustrated which represents a modification of the embodiment of FIG. 3. In this embodiment the tunnel panels are continued to the rear transom 16 and fillet panels 41 are added at the aft end of the hull. These fillet panels 41 have a lower deadrise than the UHD panels 31 and extend transversely from a position adjacent and/or slightly spaced above the outer edge of the pad keel to a point at or adjacent the outer edge of the first pair of longitudinal steps, including longitudinal step 32, at the transom and going forward past the longitudinal center of gravity (LCG) of the hull. The fillet panels 41, which typically would have a deadrise of 25 degrees to 35 degrees, (shown shaded in the drawings for clarity) are tapered symmetrically at their forward ends to blend into the adjacent UHD panels 31 and the first pair of longitudinal steps, including longitudinal step 32, forward of the LCG. The provision of these fillet panels 41 reduces peak slamming pressures attributable to the first pair of longitudinal steps, including longitudinal step 32, and the second pair of longitudinal steps, including longitudinal step 33, at the aft end of the hull and reduces wetted surface area frictional drag.

A further variation is also shown in FIGS. 4*a*-*d*, in that the fillet panels 41 bridging the pad keel and the first pair of longitudinal steps, including longitudinal step 32, may be provided with Ventilated Aft Swept Flow Interrupters (VASFI), as detailed in U.S. Pat. No. 7,845,301, the disclosure of which is incorporated herein by reference. VASFI improve planing hull efficiency but also improve turning. In the illustrated embodiment two VASFI devices 45 are used on either side of the hull centerline in fillet panels 41 in a swept back arrangement. One pair is aft of the LCG and one pair forward of the LCG. As described in U.S. Pat. No. 7,845,301 these VASFI constitute extendable plates which, when extended, act as transverse hull steps to interrupt flow and reduce wetted surface area as well as to assist in rapid turns.

Figure 5A:
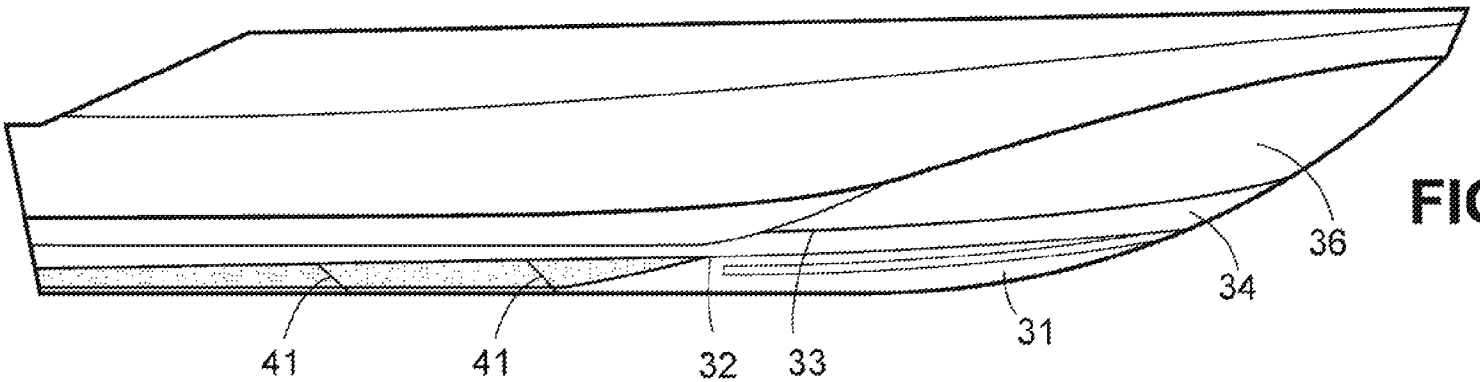
FIG. 5*a* is a side view of a third embodiment of the invention.
Figure 5B:
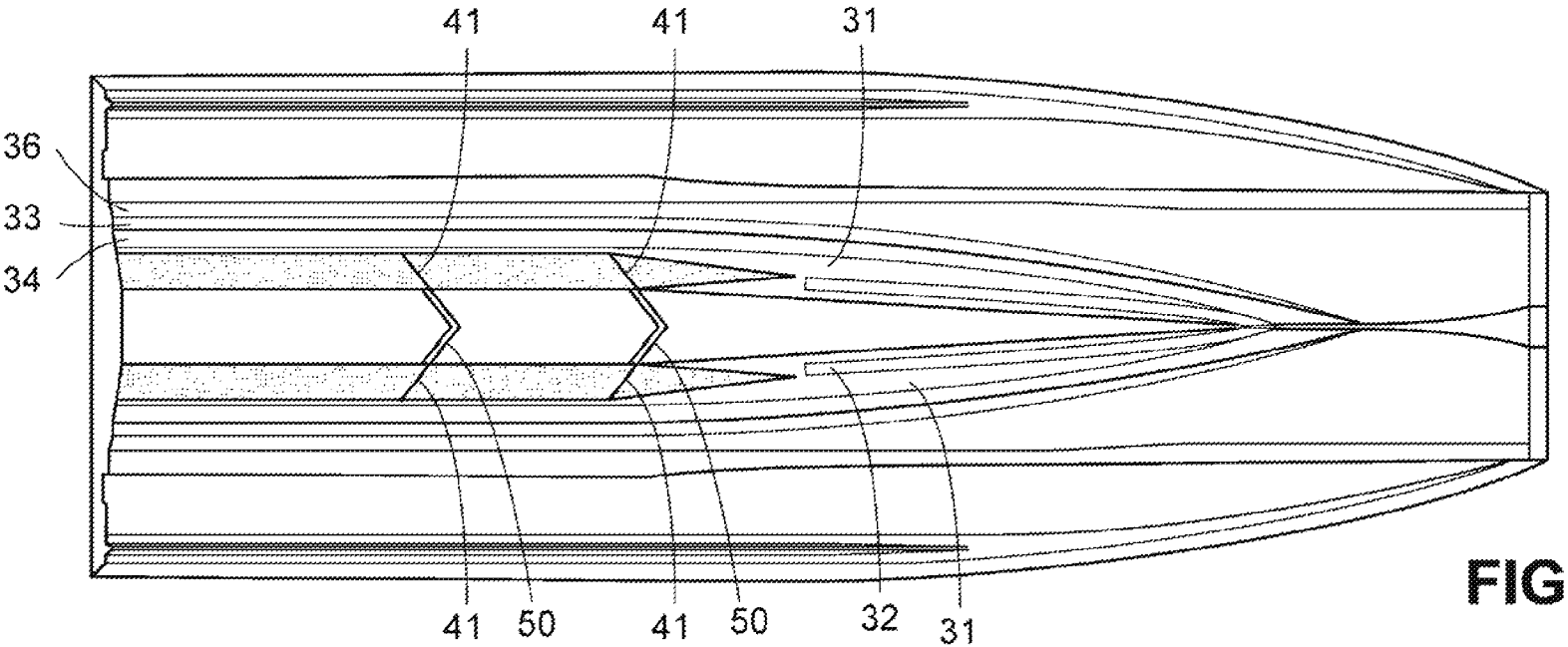
FIG. 5*b* is a bottom view of the embodiment of FIG. 5*a;*
Figure 5C:
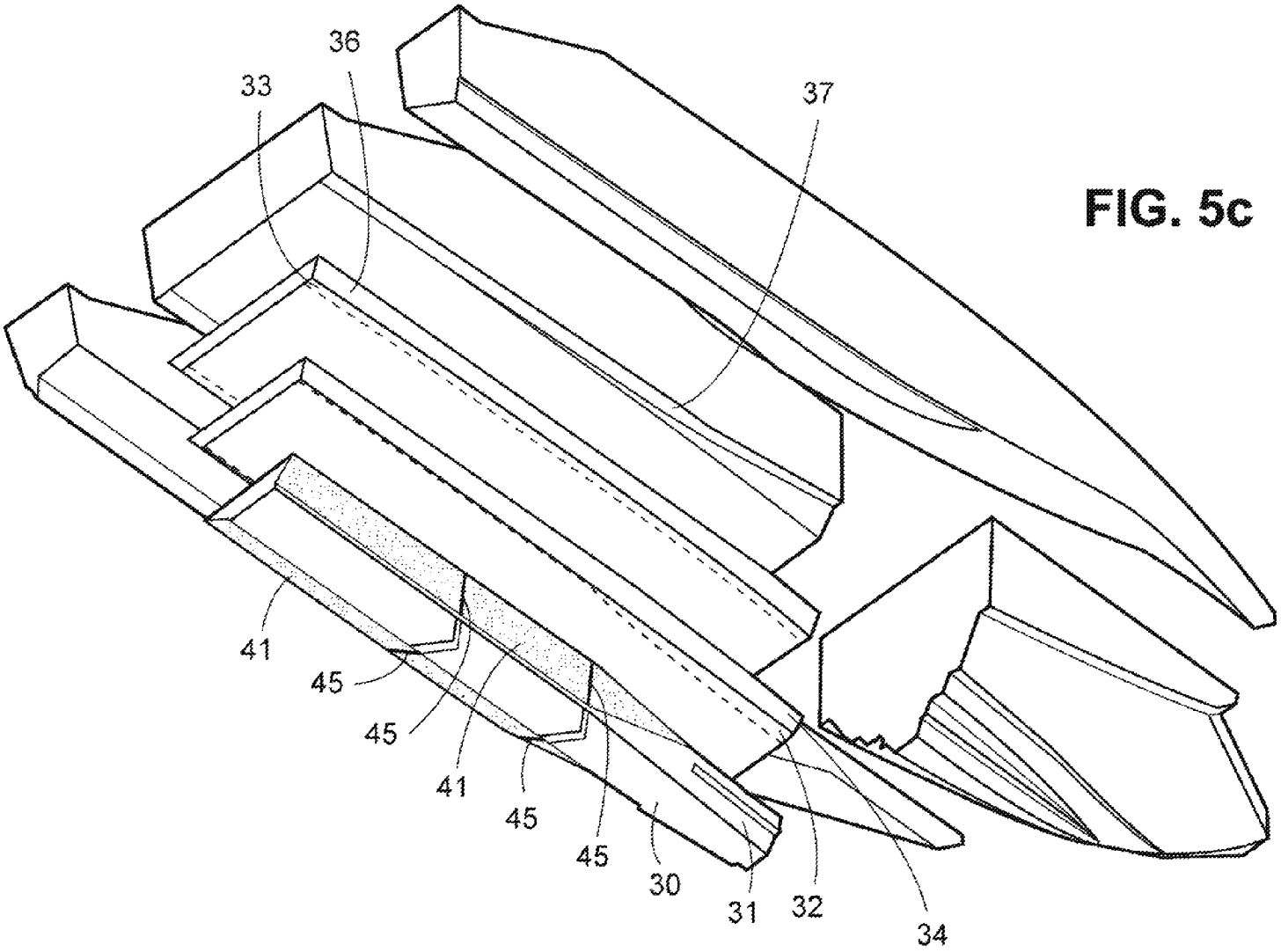
FIG. 5*c* is a bottom exploded perspective view of the embodiment of FIG. 5*a;*

Referring now to FIGS. 5*a* and 5*b*, another embodiment of the invention is shown which includes the same panel arrangement as the embodiment of FIGS. 4*a*-4*e* (wherein elements marked with the same reference number signify like parts). In this embodiment the pad keel includes a pair of transverse steps 50 formed therein. These transverse steps are swept rearwardly and ventilated from an internal hull ventilation system in any known or convenient manner. Transversely stepping a planing hull is a well-known technique to improve its efficiency by increasing the planing lift and reducing the hull drag. In the embodiments of FIGS. 4 and 5 the fillet panels 41 extend longitudinally from the transom and are tapered both longitudinally and transversely as they extend forward, gradually exposing an increasing amount of the adjacent UHD panels and the first pair of longitudinal steps, including longitudinal step 32, and the second pair of longitudinal steps, including longitudinal step 33. This creates wedge shaped panels that terminate in an apex at the joint between the adjacent UHD panels and step 32 near or forward of midship and no more than 60% of the hull's waterline from the transom. In a preferred embodiment, the forward-most points of the tapered fillet panels 41 coincide with the stagnation point on the adjacent first pair of longitudinal steps, including longitudinal step 32 to augment the stagnation pressure on the step, while allowing for the aforementioned benefits of the fillet panels 41 on the aft end of the hull.

FIGS. 5*a*-5*e* illustrate a preferred embodiment of the present invention in which the hull's hard chine and the forward end of the amas are carried forward to the bow to a straight bow portion at the top of the bow as seen in FIG. 5*b*.

Figure 5D:
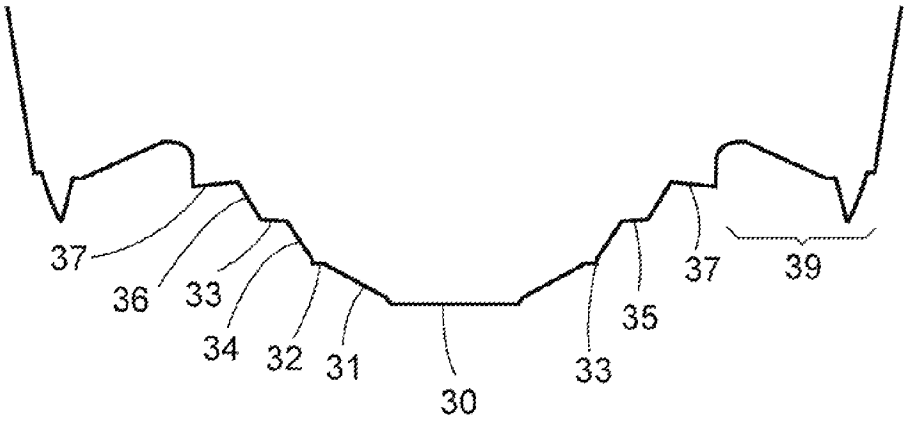
FIG. 5*d* is a transverse cross-section of the bottom of the hull of the embodiment of FIG. 5*a;*
Figure 5E:
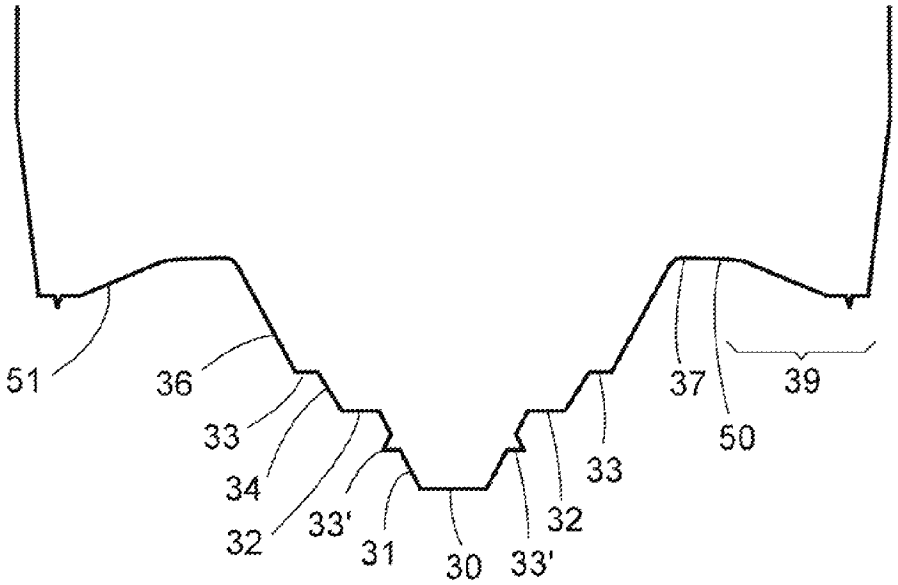
FIG. 5*e* is a transverse cross-section of the forebody of the embodiment of FIG. 5*a;*

FIGS. 5*d* and 5*e* illustrate how the deadrise of the UHD panels and the width of the both pairs of longitudinal steps, including longitudinal steps 32 and 33, may vary moving forward in the hull.

FIGS. 6*a*-6*e* illustrate another smaller embodiment of the invention whose pad keel 30 terminates forward of transom 16 defining an aft step 32'. At the transom the hull has a single UHD panel 34 on each side of the hull. At the step 32' the pad keel 30 begins, as does the UHD panel 32 longitudinal step 33 and fillet panels 41. In this embodiment the forward portion of the hull includes the strakes 31' previously described. In addition, because the height of the UHD panel 34 is greater than 6 inches between the step 33 and the chine 37 (but preferably less than 12 inches) an additional longitudinal strake 35 is provided to mitigate slamming as described above. In this case the strake is illustrated, as a flat plate member extending laterally from the hull with zero deadrise midway between chine 37 and step 33 from the bow to the transom.

Figure 6A:
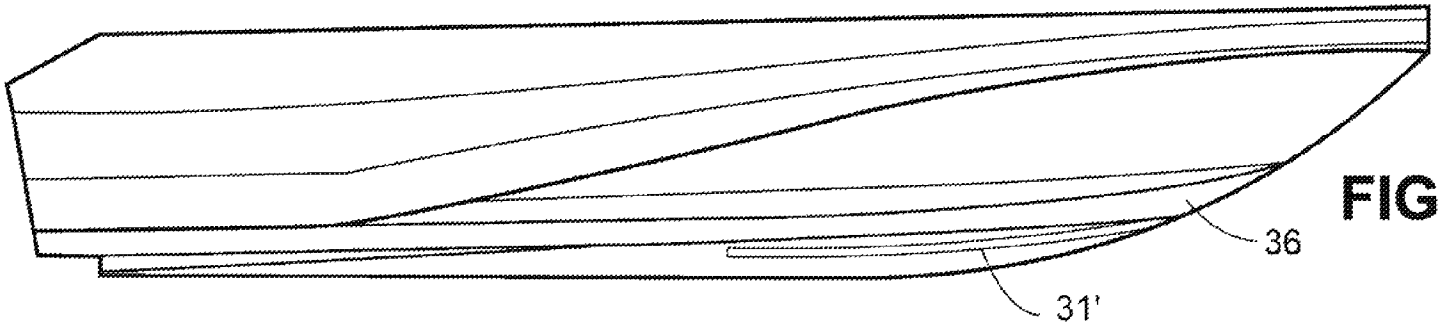
FIG. 6*a* is a side view of a fourth embodiment of the invention.
Figure 6B:
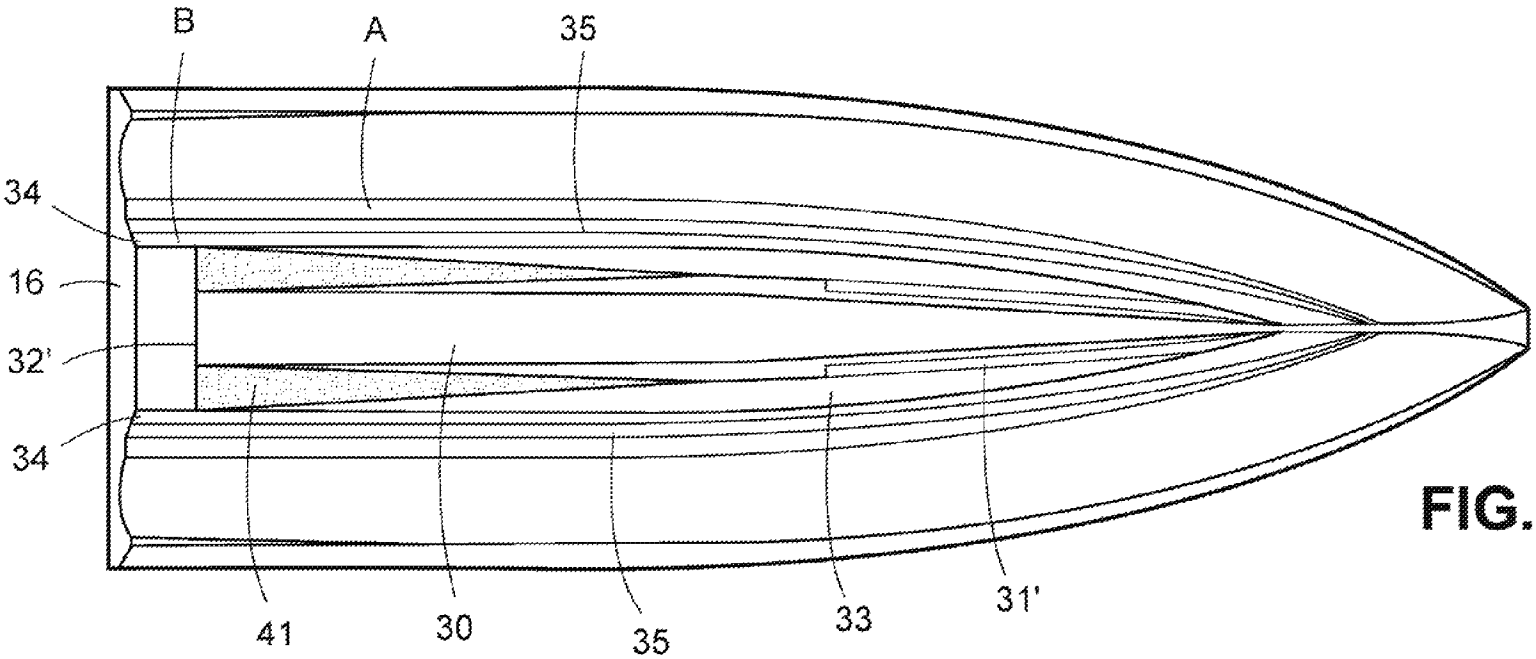
FIG. 6*b* is a bottom view of the embodiment of FIG. 6*a;*
Figure 6C:
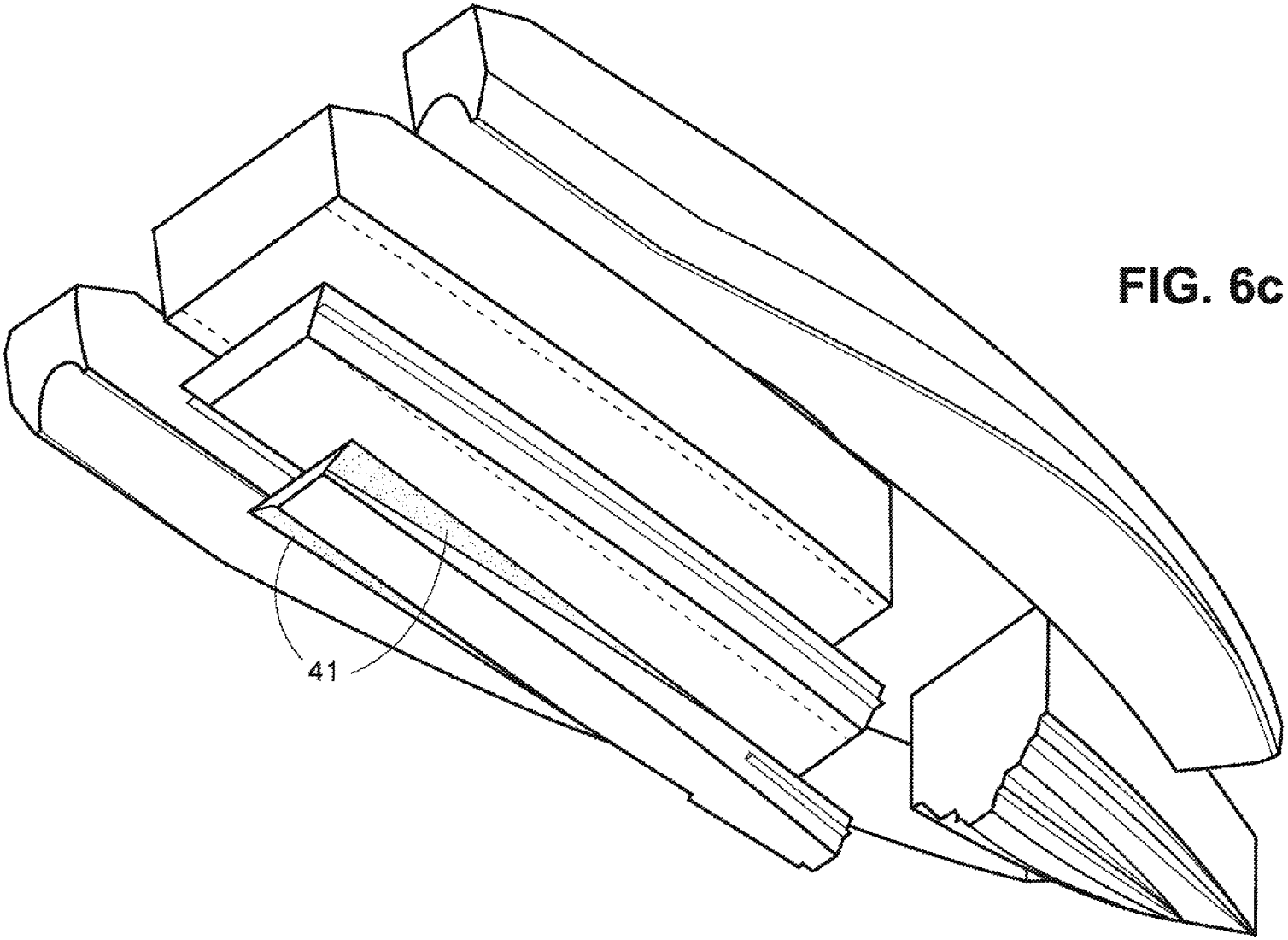
FIG. 6*c* is a bottom exploded perspective view of the embodiment of FIG. 6*a;*
Figure 6D:
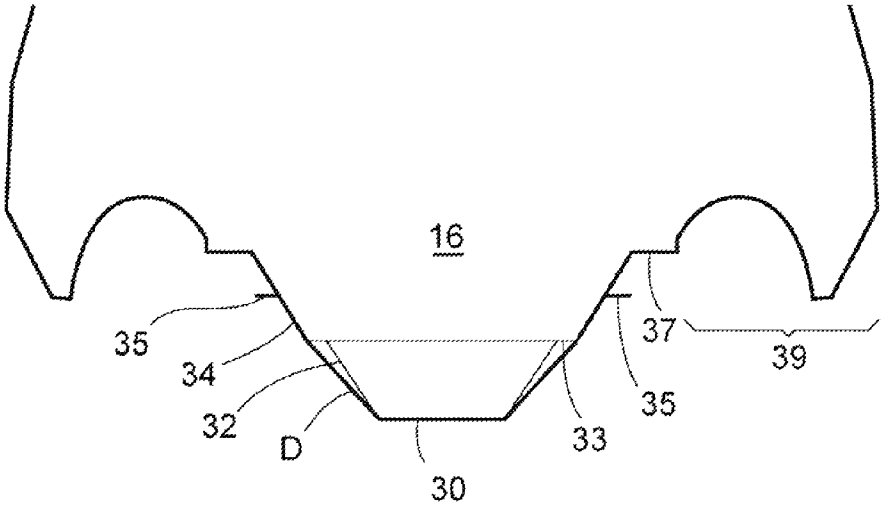
FIG. 6*d* is a transverse cross-section of the bottom of the hull of the embodiment of FIG. 6*a;*
Figure 6E:
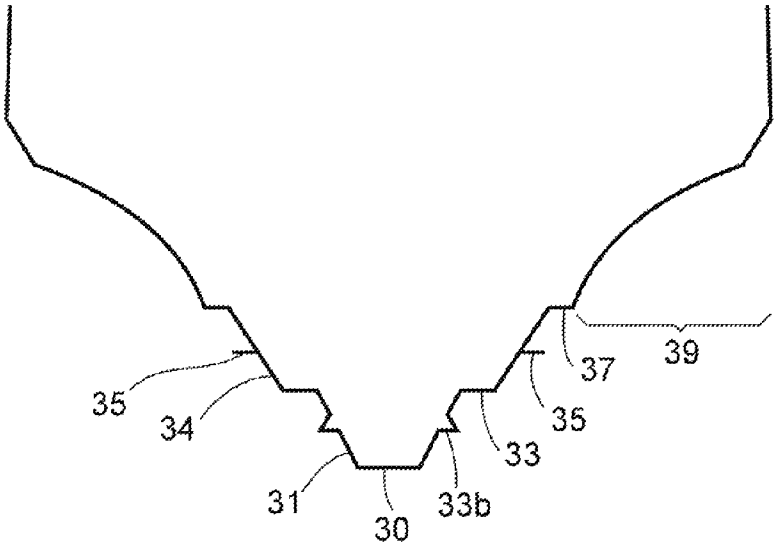
FIG. 6*e* is a transverse cross-section of the forebody of the embodiment of FIG. 6*a;*

As also seen in FIGS. 6*a*-6*c* the ama tunnel structure extends to the bow but merges into bow surface.

Figure 7:
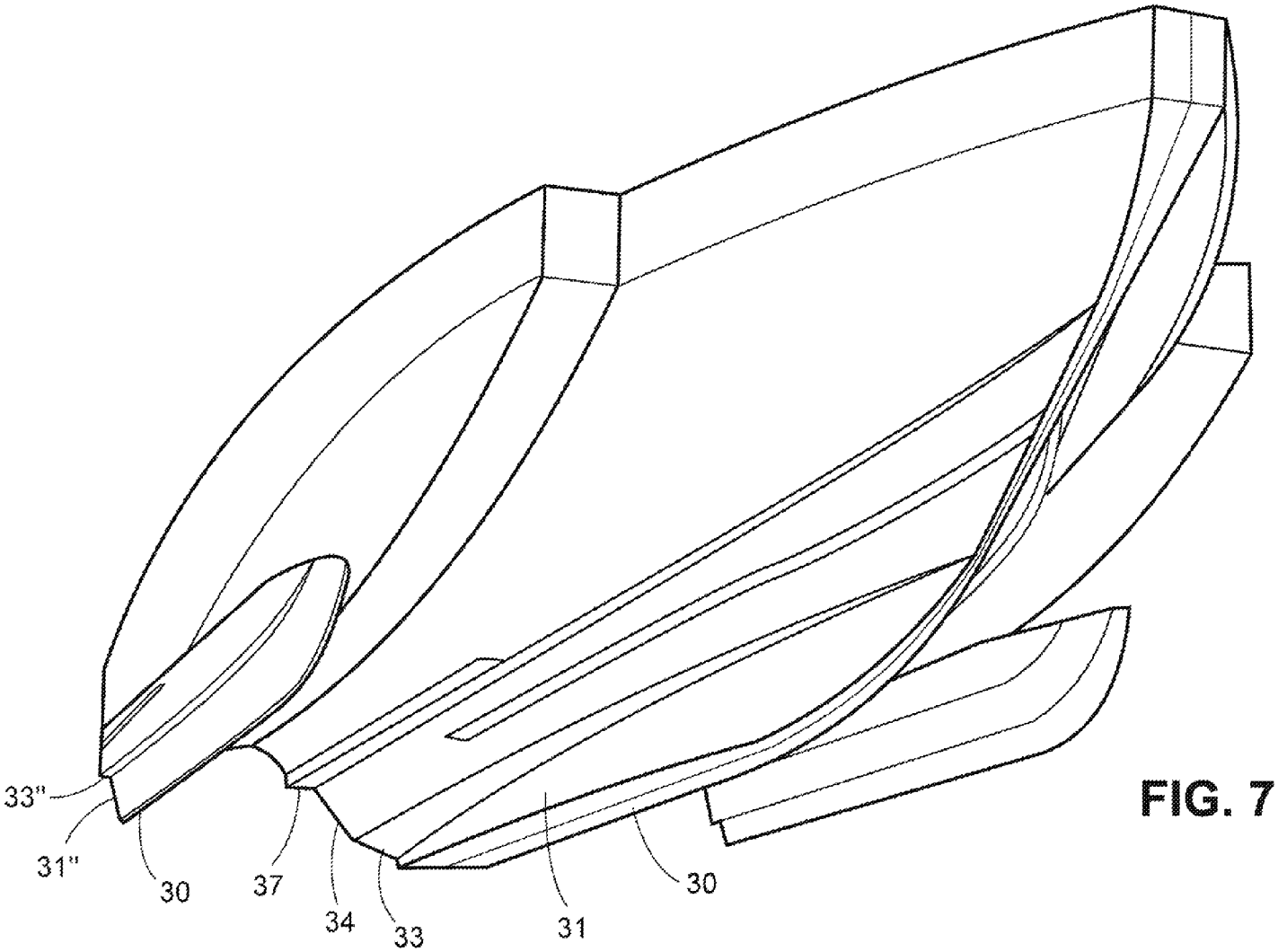
FIG. 7 is a bottom perspective view of yet another embodiment of the invention.

FIG. 7 is a schematic illustration of another embodiment of the invention in which the main hull has a pad keel, a lower pair of UHD panels 31 and a first longitudinal step 33 above it. In this case the step tapers in width moving forward to provide increased lift at the stern. A second set of UHD panels 34 are provided above the lower step. They terminate at the hard chine of the main hull above which the ama tunnels begin. In this embodiment the keels of the amas are provided as long narrow hulls constructed in accordance with this invention having narrow pad keels 30', UHD panels 31" above them terminating in longitudinal planing steps 33" and an additional pair of UHD panels above that step.

FIGS. 8*c*-8*f* are similar to previously described FIGS. 8*a* and 8*b*. They illustrate the effective deadrise on the heeled over hulls of FIGS. 3 and 5 amidships at a 15° heel. As seen therein the hull sides have significantly greater average deadrise to enter the water during rough seas and mitigate pounding as compared to a conventional V hull.

Figure 9A:
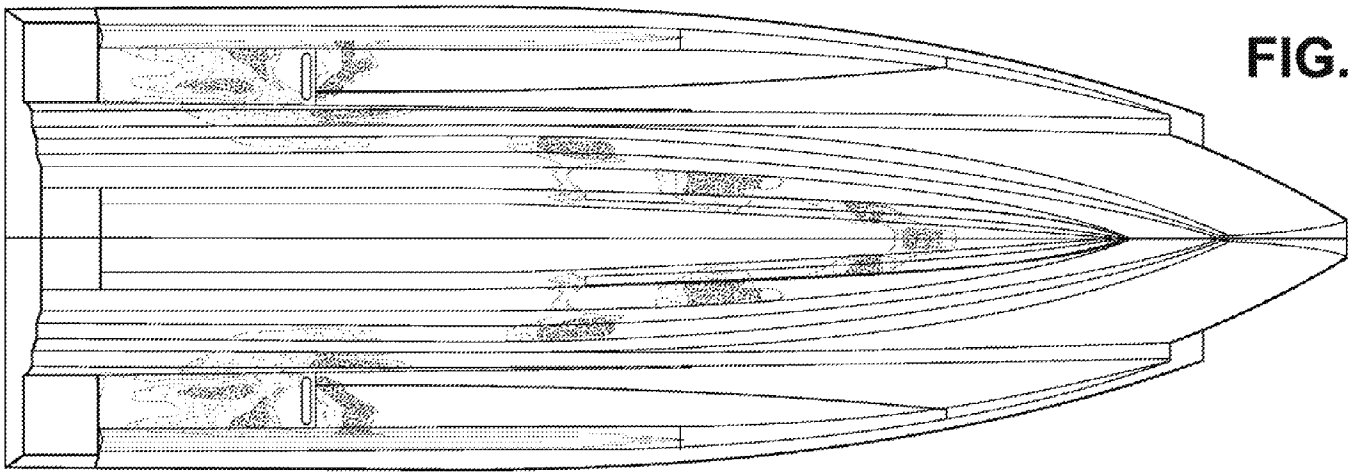
FIGS. 9*a* and 9*b* are bottom plan views of hull pressure patterns for hulls designed in accordance with the embodiments of the invention, shown in FIGS. 3*a* and 5*a* respectively.
Figure 9B:
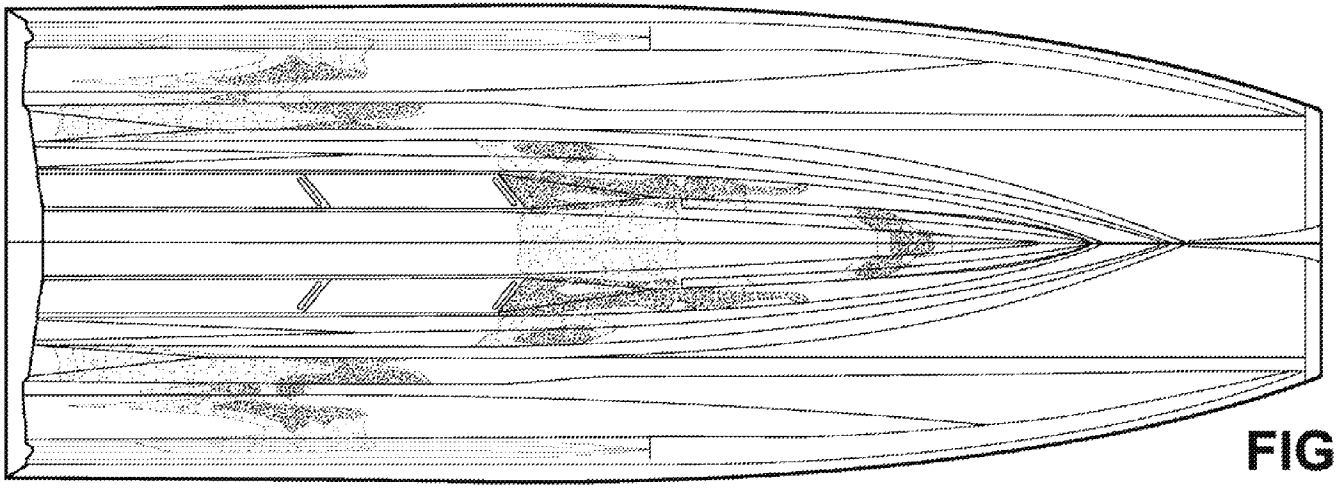

FIGS. 9*a* and 9*b* are bottom views of the hulls of FIGS. 3*a* and 5*a* shaded to show the pressure distributions on the hulls of the present invention. (The darker shaded areas are of higher pressure than the lighter ones.) As seen therein at a speed of 35 knots the hulls of this invention have a segmented planing stagnation lift line with at least two stagnation lift planing surfaces between the pad keel and chine planing flats for planing lift stability and seakindliness.

Figure 10A:
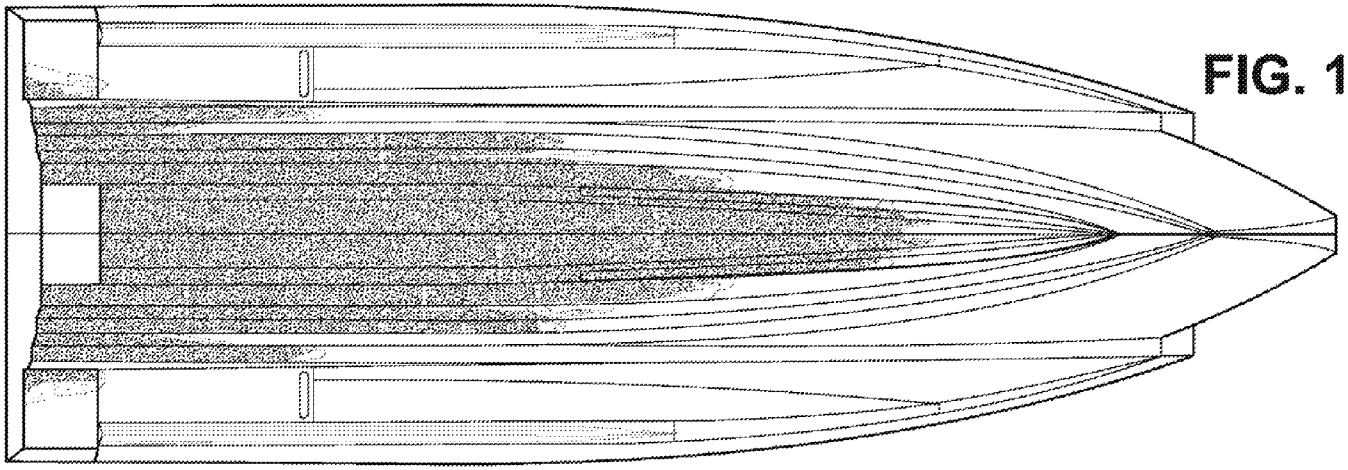
FIGS. 10*a* and 10*b* are bottom views of the hull wetting distribution on the hull bottoms of the embodiments of FIGS. 3*a* and 5*a* respectively operating a speed of about 35 knots.
Figure 10B:
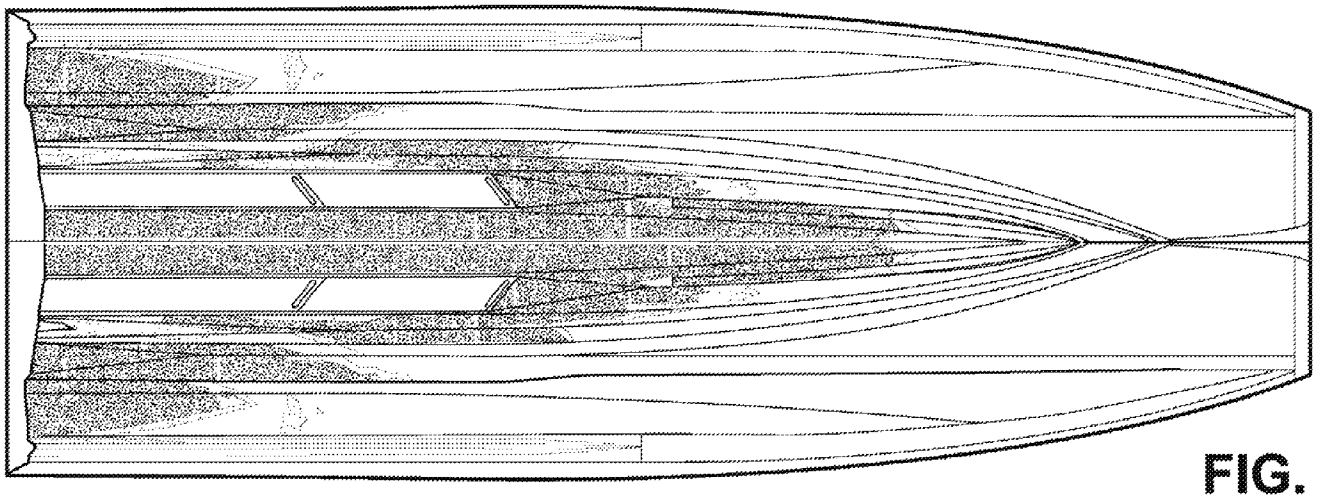

FIGS. 10*a* and 10*b* are similar bottom views showing the wetted surface areas on the hulls of FIGS. 3*a* and 5*a* at 35 knots speed. These illustrations indicate that the wetted surface areas for these hulls are generally triangular and narrow in shape, thereby minimizing drag.

As seen in FIG. 10*a* the wetted surface is staggered moving aft as the longitudinal steps interrupt flow from the UHD panel directly above it. In addition, wetting ends at the steps formed at the aft end of the pad keel and the tunnels again reducing drag. Similar effects are achieved with the hull shown in FIG. 10*b* where the VASFI interrupters act as steps and substantially reduce if not eliminate water contact with the fillet panels 41 aft of the first set of VASFI interrupters.

Figure 11A:
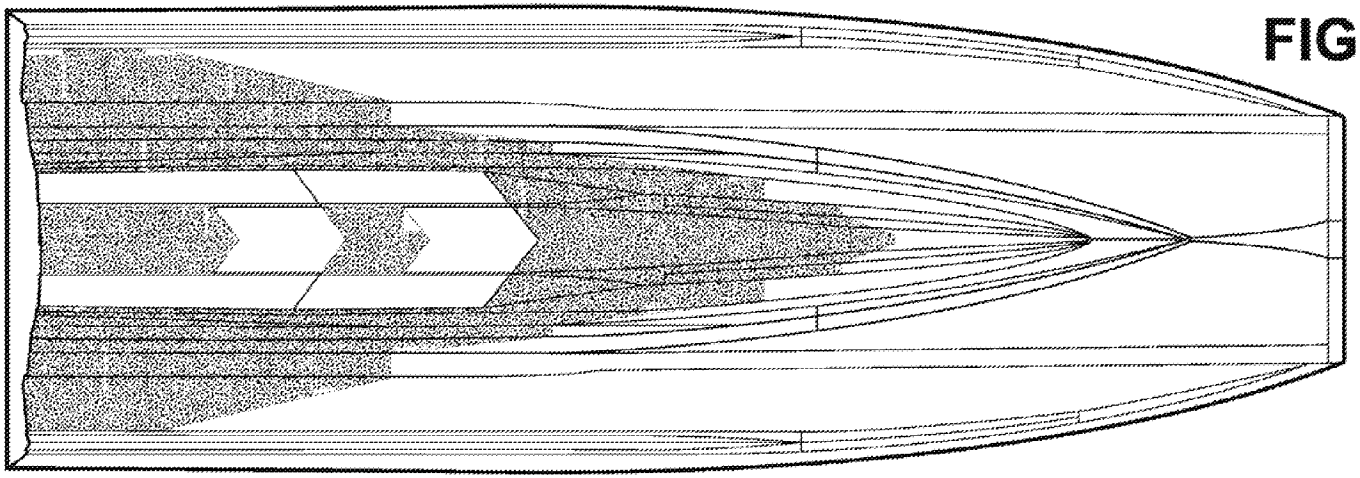
FIGS. 11*a* and 11*b* are bottom views of the hull wetting patterns for the embodiments of FIGS. 5*a* and 6*a;*
Figure 11B:
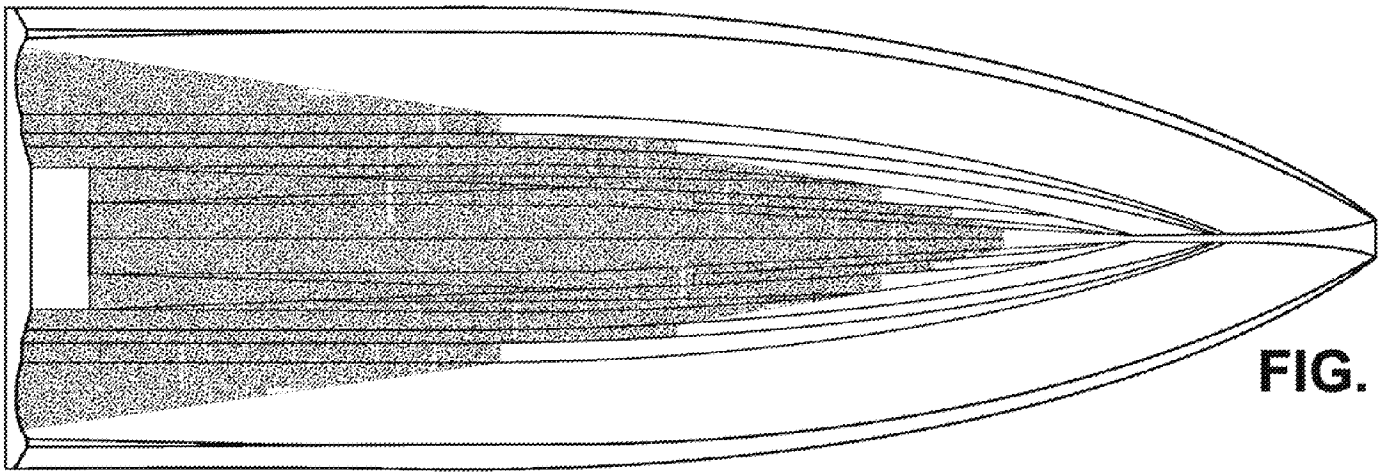
Figure 12A:
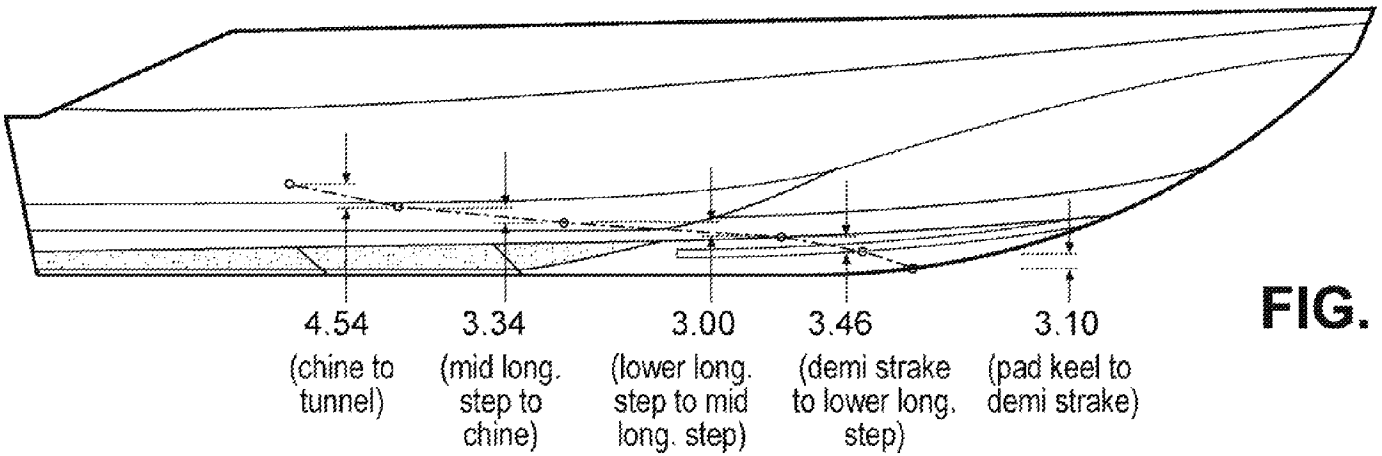
FIGS. 12*a* and 12*b* and 13*a* and 13*b* are respectively side and bottom views of the embodiments of FIGS. 5*a* and 6*a* showing the location of the stagnation lift line for those hulls and the vertical offset of the stagnation points on the hulls.
Figure 12B:
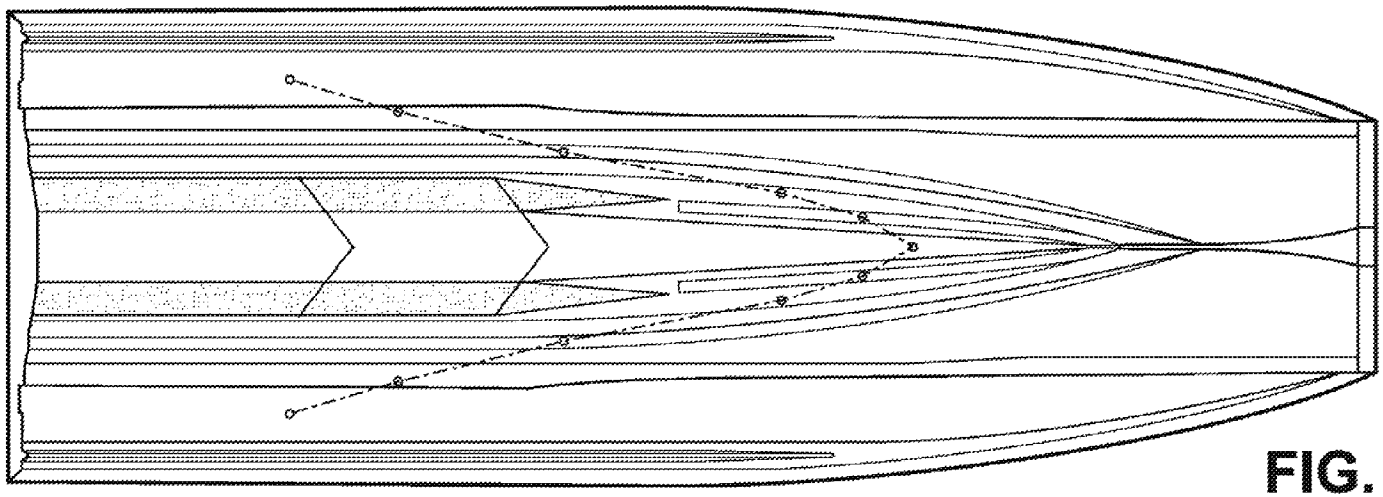
Figure 13A:
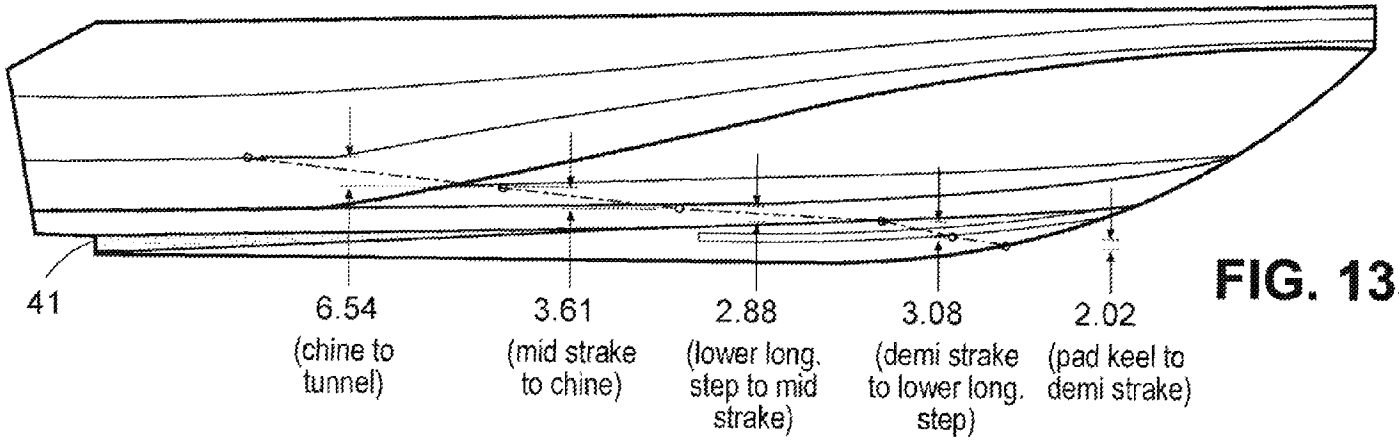
Figure 13B:
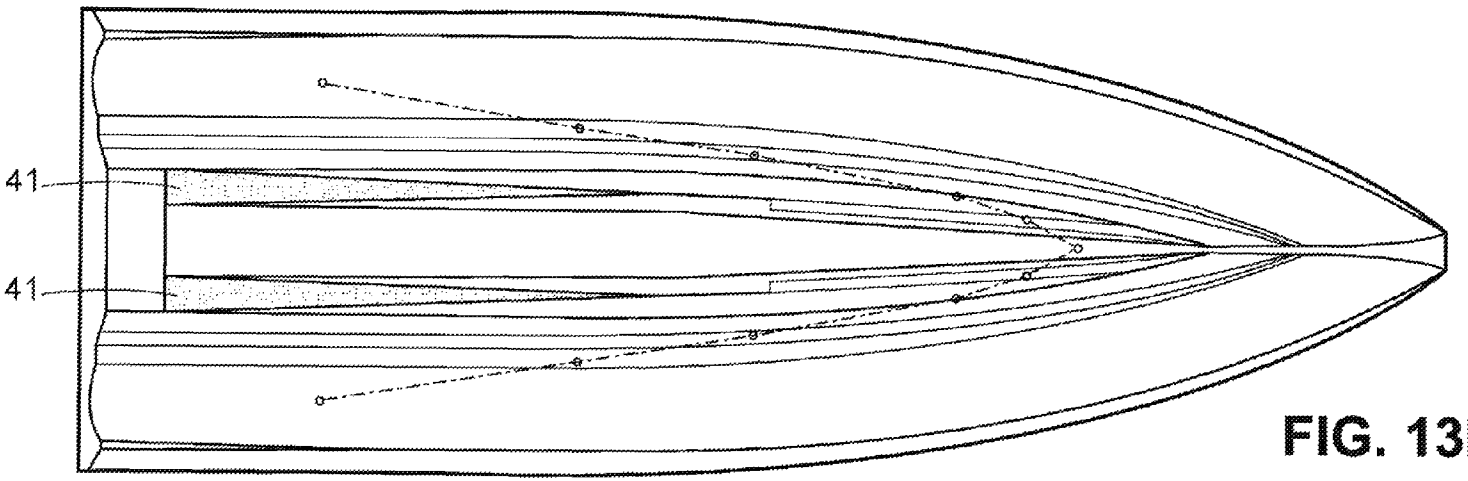

FIGS. 11*a* and 11*b* are similar to FIGS. 10*a* and 10*b* and illustrate the wetted surface areas of the hulls of FIGS. 5 and 6 at 35 knots speed. The pressure distribution patterns for those hulls will be substantially the same as the hulls of FIGS. 3 and 5.

FIGS. 12*a* and 12*b* and FIGS. 13*a* and 13*b* illustrate in dotted lines the stagnation lines for the hulls of FIGS. 5 and 6, the location of the stagnation points on the pad keels, demi-strakes, longitudinal steps, chines and ama tunnels and the vertical spacing between successive stagnation points on those hulls. The creation of a segmented stagnation line with vertically spaced stagnation points which result from the hull structures of the present invention produce a hull which will remain stable in rough seas, piercing the waves with reduced pounding while providing sufficient planing surface area to operate at high speeds.

Figure 14A:
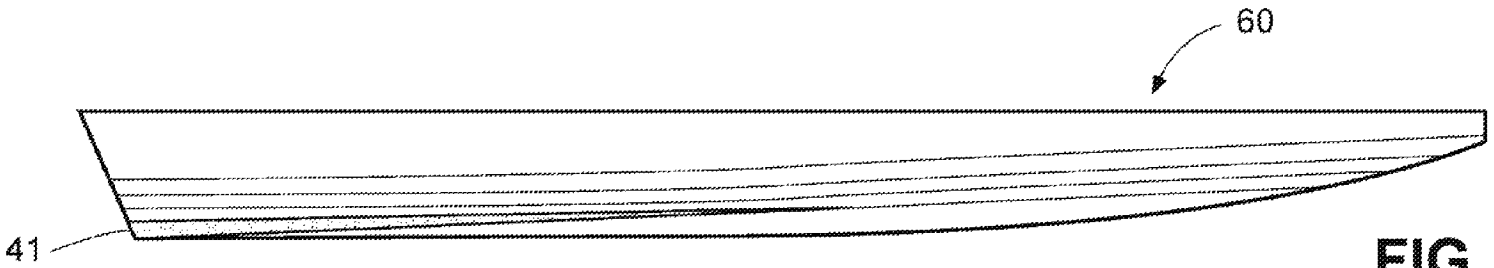
FIGS. 14*a* and 14*b* are profile and bottom plan views, respectively, of a multi-hull watercraft designed in accordance with another embodiment of the invention, featuring a twin hull or catamaran using the hull structure of the embodiment of FIG. 3*a*.
Figure 14B:
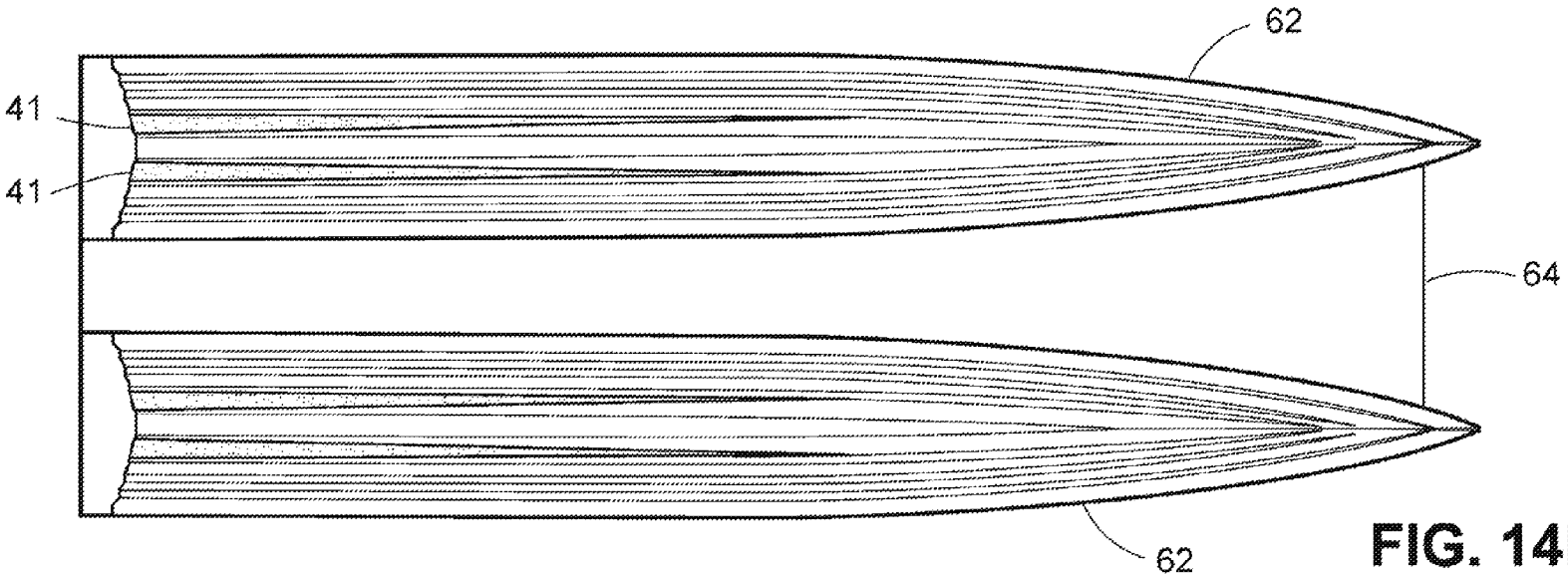
Figure 15A:
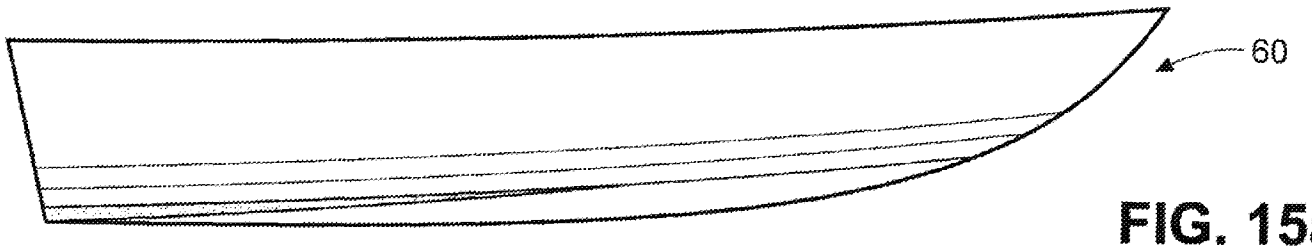
FIGS. 15*a* and 15*b* are profile and bottom plan views, respectively, of a multi-hull watercraft designed in accordance with one embodiment of the invention, featuring two half hull structures according to the embodiment of FIG. 3*a*.
Figure 15B:
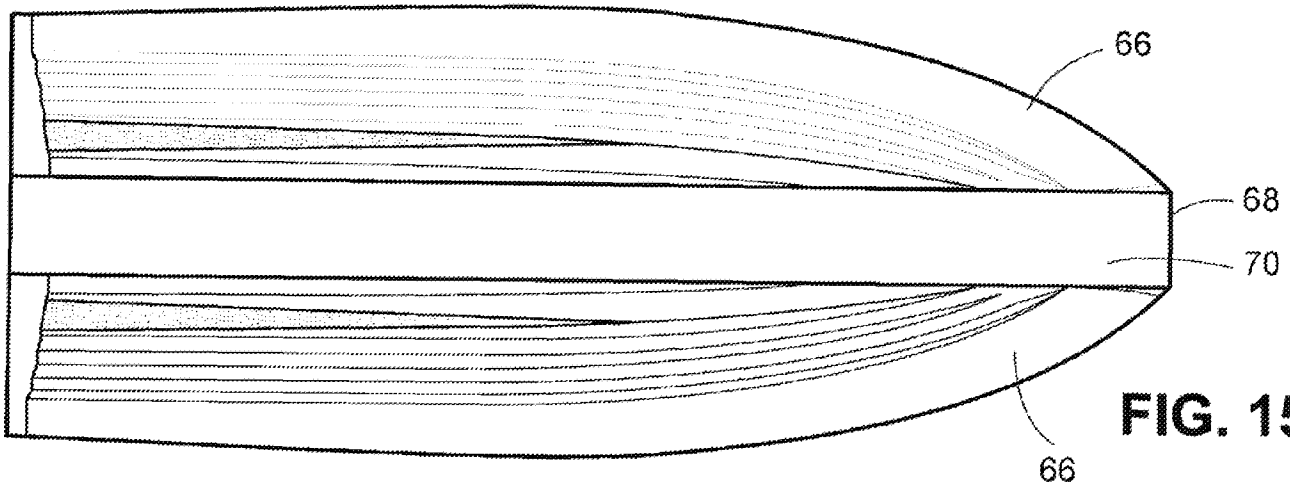

A further variation of this invention includes multi-hull watercraft comprised of two or more hull structures designed according to this invention. For example, FIGS. 14*a* and 14*b* show one embodiment comprised of a catamaran hull structure 60 including twin-hulls 62 and a deck or upper hull structure 64 between them. In another embodiment, shown in FIGS. 15*a* and 15*b* the catamaran hull structure is formed of two half hull structures 66 connected by a deck or upper hull 68 and defining a central tunnel 70.

Although illustrative embodiments of the invention have been described herein, it is to be understood that the invention is not limited to these specifically disclosed embodiments, but that various changes and modifications may be effected therein by those skilled in the art without departing from the scope or spirit of the invention.

What is claimed is:

1. A watercraft including a hull comprising:

a bow;

a transom;

a pair of chines symmetrically arranged on the hull and defining a width of the hull;

a flat pad keel having a width at the transom that is 15% to 25% of the hull width at outer hull chines as measured at the transom;

a pair of hull panels each having a deadrise angle of 50 degrees or more extending outwardly upwardly, and symmetrically and disposed about a hull centerline and connecting the flat pad keel to a first pair of longitudinal steps forming planing surfaces; and one or more additional pairs of hull panels forming longitudinal steps symmetrically disposed about the hull centerline and disposed between additional pairs of planing surfaces or strakes, which one or more additional pairs of hull panels connect the first and lowermost pair of planing surfaces or strakes to one or more additional pairs of planing surfaces or strakes, and, of the one or more additional pairs of hull panels, a most outboard pair of hull panels connect (i) to the hull chines, (ii) to a most outboard pair of planing surfaces, (iii) to entrapment tunnels, or (iv) to amas, symmetrically disposed about the hull centerline;

wherein the planing surfaces have a combined width of 14 to 20% of the hull at width outer hull chines as measured at the transom, and all hull panels have a deadrise of 50 degrees or more; and wherein at least one pair of the longitudinal steps curve upward in the bow to conform to curvature of the bow.

2. A watercraft as defined in claim 1, wherein said pair of chines include planing surfaces.

3. A watercraft as defined in claim 2, including at least one pair of strakes symmetrically disposed about the hull centerline.

4. A watercraft as defined in claim 3, wherein the strakes include flat planing surfaces that project outward and wherein the vertical offset between any two planing surfaces of the hull does not exceed six inches.

5. A watercraft as defined in claim 1, wherein said at least one pair of planing surfaces is spaced no less than 4 inches above the bottom of the flat pad keel.

6. A watercraft as defined in claim 1, including at least a second pair of hull panels symmetrically disposed about the hull centerline and having bottom edges respectively connected to said at least one pair of symmetric longitudinal planing surfaces and extending upwardly and outwardly therefrom.

7. A watercraft as defined in claim 1, further comprising strakes wherein the strakes include flat planing surfaces that project outward; and wherein vertical spacing between said at least one pair of symmetric longitudinal steps exceeds 6 inches.

8. The watercraft as defined in claim 1, further comprising fillet panels having deadrise angles of between 20 and 35 degrees located in an aft end of the hull starting at the transom and extending forward therefrom, said fillet panels being symmetrically disposed about the hull centerline and secured to a hull panel adjacent to the flat pad keel and extending laterally outwardly and upwardly to an inner edge of a longitudinal planing step immediately above the hull panel.

9. A watercraft as defined in claim 8, wherein said fillet panels taper symmetrically forward and terminate at an inboard edge of an intersection of the longitudinal planing step and a hull panel.

10. A watercraft as defined in claim 9, wherein said intersection is located a distance of no more than 60% of the hull waterline measured from the transom.

11. A watercraft as defined in claim 9, wherein the intersection of said hull panels and fillet panels is forward of midship of the hull.

12. A watercraft as defined in claim 8, wherein additional fillet panels symmetrically disposed on opposite sides of the hull centerline extend between hull panels and longitudinal steps above the hull panels.

13. A watercraft as defined in claim 8, further comprising a pair of amas, outer side hulls, or sponsons symmetrically disposed about the hull centerline, which amas define an outboard surface of entrapment tunnels.

14. A watercraft as defined in claim 8, wherein said watercraft includes at least one pair of laterally spaced and connected deep V hulls.

15. A watercraft as defined in claim 8, wherein said watercraft is a multihull vessel comprising two or more half hull structures.

16. A watercraft as defined in claim 8, wherein said hull has at least one transverse step formed therein.

17. A watercraft as defined in claim 1, further comprising a pair of amas, outer side hulls or sponsons symmetrically disposed about the hull centerline, which amas define an outboard surface of entrapment tunnels.

18. A watercraft as defined in claim 1, wherein said watercraft includes at least one pair of laterally spaced and connected deep V hulls.

19. A watercraft as defined in claim 1, wherein said watercraft is a multihull vessel comprising two or more half hull structures.

20. A watercraft as defined in claim 1, wherein said hull has at least one transverse step formed therein.

21. A watercraft as defined in claim 1, wherein said watercraft includes at least one pair of laterally spaced connected hulls.

22. A watercraft comprising at least one hull comprising:

a hull centerline, a bow, a transom, a pair of chines symmetrically arranged on the hull and defining a width of the hull;

a flat pad keel having a width which is 15% to 25% of the width of the hull at outer hull chines as measured at the transom;

at least one pair of lower hull panels, outboard of and adjacent to said flat pad keel, and located symmetrically about the hull centerline, each panel having a deadrise of 50 degrees or more degrees a bottom edge connected to the flat pad keel, and a top edge;

at least one pair of symmetric longitudinal hull steps respectively adjacent to and above said hull panels and located symmetrically about the hull centerline, the lowermost of said at least one pair of symmetric longitudinal hull steps having respectively inner edges connected to the top edges of the hull panels and extending outwardly, wherein the flat planing surfaces of the lowermost symmetric longitudinal hull steps have a combined width of 14 to 20% of the width of the hull at the hull chines as measured at the transom; and further comprising, a pair of amas (outer side hulls or sponsons) symmetrically disposed about the hull centerline, each of which amas defines an entrapment tunnel.

23. A watercraft as defined in claim 22, wherein said hull has a forebode and a curved bow and said flat pad keel curves upwards in the forebody of the hull, following the curvature of the bow.

24. A watercraft as defined in claim 23, wherein said flat pad keel has a forward section which tapers to an apex located where the at least one pair of lower hull panels intersect at the bow to form a deadrise angle of 50 to 60 degrees.

25. A watercraft as defined in claim 24, wherein said apex of said flat pad keel is between a forefoot of the hull and a point of intersection of a design waterline with the bow.

26. A watercraft as defined in claim 24, wherein said deadrise panels extend from the transom to the apex of said flat pad keel.

27. A watercraft as defined in claim 22, further comprising at least one additional pair of higher hull panels having a deadrise of 50 degrees or more degrees outboard and above the lowermost hull panels, which higher hull panels are symmetrically disposed on opposite sides of the hull centerline outboard of the lowermost hull panels, the outboard edges of which higher hulls panels join the inner edges of longitudinal hull steps symmetrically disposed on opposite sides of the hull centerline.

28. A watercraft as defined in claim 27, wherein the longitudinal hull steps joined to the higher hull panels include planing surfaces that extend forward from the transom and converge forward of midship toward the top of the hull at an angle greater than the angle at which the hull centerline converges forward of midship toward the top of the hull.

29. A watercraft as defined in claim 22, wherein the amas include a downward projection terminating in an apex.

30. A watercraft as defined in claim 22, wherein said hull has at least one transverse step formed therein.

* * * * *